US011724515B2

(12) United States Patent
Nishida

(10) Patent No.: US 11,724,515 B2
(45) Date of Patent: Aug. 15, 2023

(54) INKJET PRINTER AND NON-TRANSITORY COMPUTER-READABLE STORAGE MEDIUM STORING COMPUTER-READABLE INSTRUCTIONS

(71) Applicant: BROTHER KOGYO KABUSHIKI KAISHA, Nagoya (JP)

(72) Inventor: Katsunori Nishida, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/706,030

(22) Filed: Mar. 28, 2022

(65) Prior Publication Data

US 2022/0219461 A1 Jul. 14, 2022

Related U.S. Application Data

(63) Continuation of application No. PCT/JP2021/011910, filed on Mar. 23, 2021.

(30) Foreign Application Priority Data

Mar. 31, 2020 (JP) ..... 2020-065206

(51) Int. Cl.
*B41J 2/18* (2006.01)

(52) U.S. Cl.
CPC ..... *B41J 2/18* (2013.01)

(58) Field of Classification Search
CPC ..... B41J 2/01; B41J 2/1714; B41J 2/18; B41J 2/175; B41J 2/165
See application file for complete search history.

(56) References Cited

U.S. PATENT DOCUMENTS 8,915,572 B2 12/2014 Levi
9,073,330 B2 * 7/2015 Iwata ..... B41J 2/175
(Continued)

FOREIGN PATENT DOCUMENTS

EP 2631075 A2 8/2013
JP 2006256128 A 9/2006
(Continued)

OTHER PUBLICATIONS

Written Opinion and partial English translation issued in corresponding PCT Application No. PCT/JP2021/011910, dated Jun. 1, 2021 (7 pages).
(Continued)

*Primary Examiner* — An H Do
(74) *Attorney, Agent, or Firm* — K&L Gates LLP

(57) ABSTRACT

An inkjet printer includes a nozzle surface provided on a head and having a nozzle ejecting ink, first and second flow paths connected to the head, a bypass flow path connecting the first and second flow paths outside the head, a cap provided to be in contact with the nozzle surface, and a controller. The controller executes circulation of the ink through the first flow path, the head and the second flow path, in a liquid-contact state where a cleaning liquid supplied in the cap is contacted with the nozzle surface, at an end of last printing or when an elapsed time from last cleaning in the cap is within a predetermined time, and circulation of the ink through the first flow path, the bypass flow path and the second flow path without passing through the head when the elapsed time is longer than the predetermined time.

9 Claims, 16 Drawing Sheets

(56) References Cited

U.S. PATENT DOCUMENTS

| | | | | |
|---|---|---|---|---|
| 10,596,810 | B2 * | 3/2020 | Suzuki | B41J 2/14209 |
| 10,821,732 | B2 * | 11/2020 | Nishida | B41J 29/38 |
| 2017/0120602 | A1 | 5/2017 | Nakai et al. | |
| 2018/0281437 | A1 | 10/2018 | Nishida et al. | |
| 2019/0193404 | A1 | 6/2019 | Nishida et al. | |
| 2019/0358961 | A1 | 11/2019 | Nishida et al. | |

FOREIGN PATENT DOCUMENTS

| | | | |
|---|---|---|---|
| JP | 2014180861 | A | 9/2014 |
| JP | 2017087708 | A | 5/2017 |
| JP | 2018171848 | A | 11/2018 |
| JP | 2019116054 | A | 7/2019 |

OTHER PUBLICATIONS

International Search Report for Application No. PCT/JP2021/011910, dated Jun. 1, 2021 (2 pages).

* cited by examiner

| Fig. 9A |
| --- |
| Fig. 9B |

INKJET PRINTER AND NON-TRANSITORY COMPUTER-READABLE STORAGE MEDIUM STORING COMPUTER-READABLE INSTRUCTIONS

CROSS-REFERENCE TO RELATED APPLICATION

This is a continuation application of International Application No. PCT/JP2021/011910 filed on Mar. 23, 2021 which claims the benefit of priority from Japanese patent application No. 2020-065206 filed on Mar. 31, 2020. The entire contents of the earlier applications are incorporated herein by reference.

BACKGROUND

Known is an inkjet printer configured to circulate ink for purposes of removing air bubbles and eliminating sedimentation of ink components in a head or in a flow path from an ink storage unit to the head. For example, an inkjet printer includes a plurality of pressure generating chambers, a supply liquid chamber, a plurality of supply passages, a circulating liquid chamber, a plurality of circulation passages, and a circulation tank. The pressure generating chambers are configured to individually communicate with a plurality of nozzles and to apply a pressure to ink. The supply liquid chamber is configured to accommodate ink that is supplied to the pressure generating chambers. The supply passages are configured to supply the ink from the supply liquid chamber to the pressure generating chambers. The circulation passages are configured to communicate the pressure generating chambers and the circulating liquid chamber, and to cause the ink in the pressure generating chambers to be accommodated in the circulating liquid chamber. The ink in the circulating liquid chamber is sent to the circulation tank. Therefore, the ink is collected from the circulating liquid chamber to the circulation tank via the circulation passages, together with air bubbles. In addition, the ink circulation eliminates sedimentation of ink components.

In the inkjet printer, when a circulation speed of the ink is increased so as to further remove air bubbles and eliminate sedimentation of ink components, meniscus of the nozzles may be destroyed. In this case, the air bubbles may be drawn into the head from the nozzles. Therefore, it is considered to circulate the ink through a circulation flow path in a liquid-contact state where a cap is filled with the ink or a cleaning liquid. However, there is a possibility that ink will flow out from the nozzles into the cap and the ink will remain in the cap.

SUMMARY

An object of the present disclosure is to provide an inkjet printer and a non-transitory computer-readable storage medium storing computer-readable instructions, which enable to reduce circulation of ink to reduce ink that will flow into a cap.

A first aspect of the present disclosure is an inkjet printer including a nozzle surface, a first flow path, a second flow path, a bypass flow path, a cap and a controller. The nozzle surface is provided on a head and having a nozzle configured to eject ink. The first flow path is connected to the head. The second flow path is connected to the head. The bypass flow path is configured to connect the first flow path and the second flow path outside the head. The cap is provided to be in contact with the nozzle surface. The controller is configured to execute head-inside circulation of circulating the ink through the first flow path, the head and the second flow path, in a liquid-contact state where a cleaning liquid supplied in the cap is contacted with the nozzle surface, at an end of last printing or in a case where an elapsed time from last cleaning in the cap is within a predetermined time, and head-outside circulation of circulating the ink through the first flow path, the bypass flow path and the second flow path without passing through the head, in a case where the elapsed time is longer than the predetermined time.

In the case where the elapsed time from the last cleaning in the cap is longer than the predetermined time, the inkjet printer according to the first aspect performs the head-outside circulation without performing the head-inside circulation. Therefore, it is possible to reduce a possibility that the ink will flow into the cap, and to reduce an amount of ink remaining in the cap.

A second aspect of the present disclosure is a non-transitory computer-readable medium storing computer-readable instructions, when executed by a computer of an inkjet printer. The inkjet printer includes a nozzle surface, a first flow path, a second flow path, a bypass flow path, a cap and the computer. The nozzle surface is provided on a head and having a nozzle configured to eject ink. The first flow path is connected to the head. The second flow path is connected to the head. The bypass flow path is configured to connect the first flow path and the second flow path outside the head. The cap is provided to be in contact with the nozzle surface. The computer-readable instructions cause the computer to execute head-inside circulation of circulating the ink through the first flow path, the head and the second flow path, in a liquid-contact state where a cleaning liquid supplied in the cap is contacted with the nozzle surface, at an end of last printing or in a case where an elapsed time from last cleaning in the cap is within a predetermined time, and head-outside circulation of circulating the ink through the first flow path, the bypass flow path and the second flow path without passing through the head, in a case where the elapsed time is longer than the predetermined time.

Due to the non-transitory computer-readable medium according to the second aspect, the similar effects to those of the first aspect of the present disclosure are obtained.

DETAILED DESCRIPTION

A schematic configuration of a printer 1 will be described with reference to FIGS. 1 and 2. The upper, lower, left lower, right upper, right lower and left upper in FIG. 1 are the upper, lower, front, rear, right and left of the printer 1, respectively.

Figure 1:
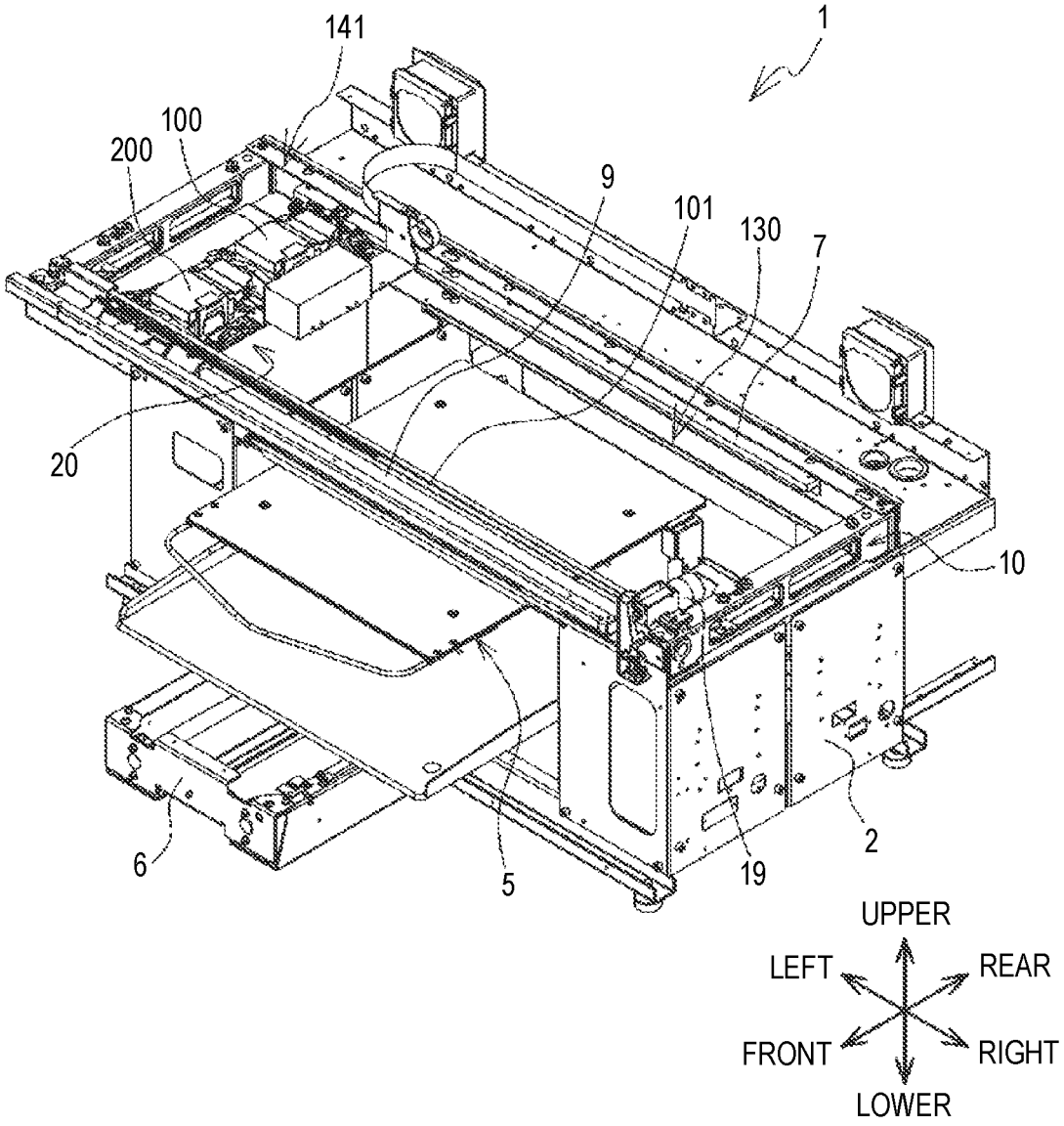
FIG. 1 is a perspective view of an internal structure of a printer 1.

As shown in FIG. 1, the printer 1 is configured to perform printing by ejecting ink onto a printing medium (not shown) such as a paper and cloth such as a T-shirt. In the present embodiment, the printer 1 is configured to print a color image on the printing medium by ejecting downward five types of inks (white (W), black (K), yellow (Y), cyan (C), and magenta (M)) different from each other. In descriptions below, white ink of the five types of inks is referred to as white ink, and inks of four colors of black, cyan, yellow and magenta are referred to as color ink when they are collectively referred to. Further, when collectively referring to white ink and color ink or when any one is not specified, they are simply referred to as ink. By including a resin component in the ink, the adhesion of the ink to the printing medium is improved. The white ink also contains an emulsion and contains titanium oxide as a pigment. Titanium oxide has a relatively high specific gravity, and pigment particles tend to precipitate. Therefore, when printing of the white ink is not performed for a long time, it is preferable to perform the printing by the white ink after eliminating the precipitation of the white ink.

As shown in FIG. 1, the printer 1 includes a housing 2, a frame body 10, a guide shaft 9, a rail 7, a carriage 20, head units 100 and 200, a drive belt 101, a drive motor 19, a platen drive mechanism 6, a platen 5, and the like. The housing 2 is provided with an operation unit (not shown). The operation unit includes a display 45 (refer to FIG. 8) and an operation button 46 (refer to FIG. 8). The operation button 46 is operated when an operator inputs instructions concerning various operations of the printer 1.

The frame body 10 has a substantially rectangular frame shape, in plan view, and is installed on an upper part of the housing 2. The frame body 10 is configured to support the guide shaft 9 on a front side and the rail 7 on a rear side, respectively. The guide shaft 9 extends in a right and left direction inside the frame body 10. The rail 7 is arranged to face the guide shaft 9 extending in the right and left direction. The carriage 20 is supported to be conveyable in the right and left direction along the guide shaft 9. As shown in FIG. 1, the head units 100 and 200 are arranged in a front and rear direction and mounted on the carriage 20. The head unit 100 is located behind the head unit 200.

The drive belt 101 is bridged along the right and left direction inside the frame body 10. The drive motor 19 is provided on a right front part inside the frame body 10. The drive motor 19 is connected to the carriage 20 via the drive belt 101. When the drive motor 19 drives the drive belt 101, the carriage 20 reciprocally moves in the right and left direction (scanning direction). This causes the head units 100 and 200 to reciprocally move in the right and left direction.

The platen drive mechanism 6 includes a pair of guide rails (not shown) and the platen 5. The pair of guide rails extends in the front and rear direction inside the platen drive mechanism 6 and is configured to support the platen 5 so as to be movable in the front and rear direction. The platen 5 is provided below the frame body 10. The platen 5 is configured to hold the printing medium at the top. The platen drive mechanism 6 is configured to be driven by a sub-scanning drive unit 16 (refer to FIG. 8), which will be described later, thereby moving the platen 5 in the front and rear direction along the pair of guide rails. Printing is performed on the printing medium by ejecting the ink from a head part 110 configured to reciprocally move in the right and left direction while the platen 5 conveys the printing medium in the front and rear direction (sub-scanning direction).

Figure 2:
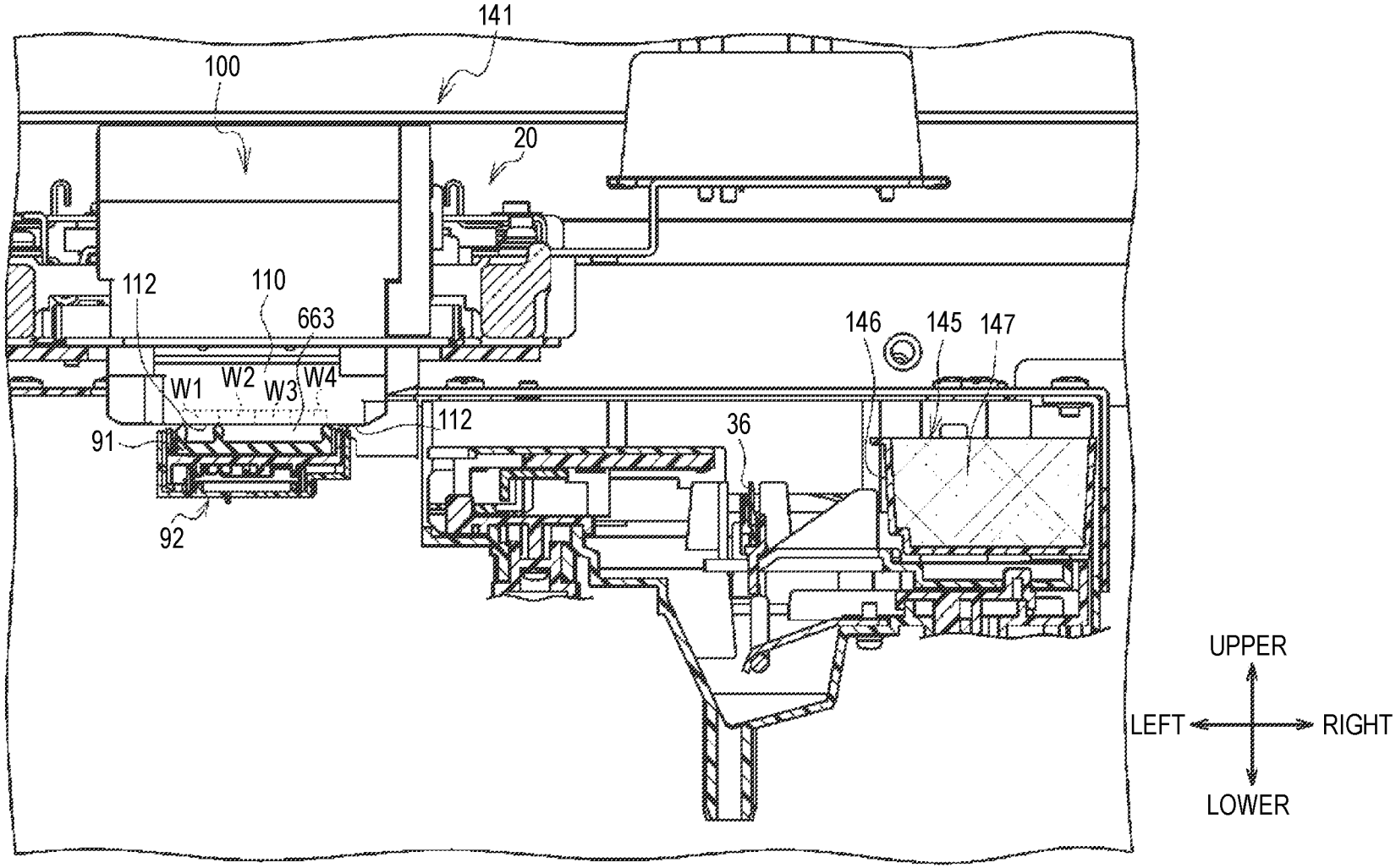
FIG. 2 is a longitudinal sectional view of the internal structure of the printer 1.

As shown in FIG. 2, a maintenance unit 141 of the printer 1 includes a wiper 36, a flushing receiving part 145, a cap 91 and a cap support part 92. The cap 91 is supported by the cap support part 92, and is provided to be in contact with a nozzle surface 112, which will be described later, on an outside of a first nozzle row W1, a second nozzle row W2, a third nozzle row W3, and a fourth nozzle row W4 (which will be described later) by a cap drive unit 18 (refer to FIG. 8). The flushing receiving part 145 is provided on a right part of the maintenance unit 141. The flushing receiving part 145 has a container portion 146 and an absorbing body 147. The flushing receiving part 145 is configured to receive ink ejected from the head part 110 of the head unit 100 by a flushing operation The ink is absorbed by the absorbing body 147. A variety of maintenance operations such as flushing and purge for restoring ink ejection performance of the head unit 100 and ensuring a printing quality of the printer 1 are executed by the maintenance unit 141. The flushing is an operation in which the head part 110 ejects ink on the flushing receiving part 145, which will be described later, before executing printing on a printing medium. The ink in nozzles 111 (refer to FIG. 3), which will be described later, is ejected by selective flushing, which will be described later, so that ink containing settled pigment, air bubbles, or a cleaning liquid introduced from the nozzles 111 is removed. The purge is an operation in which the ink is sucked and discharged from the nozzles 111 by a suction pump 190 (refer to FIG. 8) in a state where a plurality of nozzles 111 is covered with the cap 91 on the nozzle surface 112. By executing the suction operation, the ink whose viscosity has been increased due to drying in the vicinity of the nozzles 111 can be removed, so that a possibility of poor ejection in the head part 110 can be reduced. The wiper 36 can move in an upper and lower direction and perform a nozzle surface wiping operation of wiping off extra ink and the like remaining on a surface of the nozzle surface 112 of the head part 110. By executing the nozzle surface wiping operation, the printer 1 can reduce, for example, a possibility that the ink remaining on the nozzle surface 112 is fixed and it becomes difficult to eject the ink from the nozzle surface 112. The maintenance operations are executed under control of a CPU 11 (refer to FIG. 8) of the printer 1.

<Head Unit 100>

Figure 3:
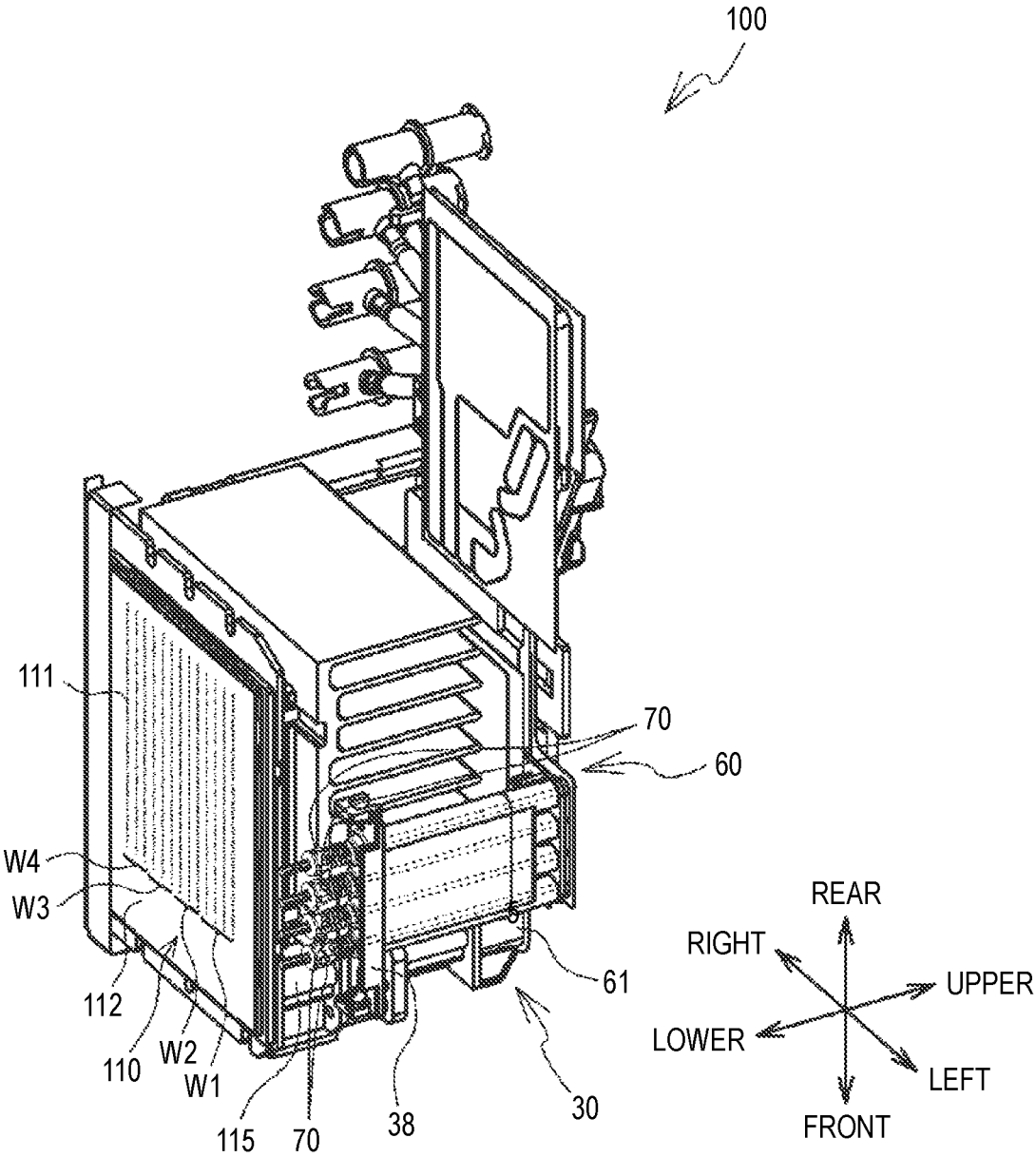
FIG. 3 is a perspective view of a head unit 100.

A detailed configuration of the head unit 100 is described with reference to FIGS. 3 and 4. As shown in FIG. 3, the head unit 100 includes a housing 30, a head part 110, a buffer tank 60, and the like. The housing 30 has a substantial box shape and is configured to support the head part 110 configured to eject ink at a lower part. An inside of the head part 110 is divided into, for example, four ink chambers (not shown) configured to supply white ink to manifolds 170A, 180A, 170B and 180B (refer to FIG. 6). The head part 110 has a planar nozzle surface 112. The nozzle surface 112 is provided with a plurality of nozzles 111 for ejecting white ink. The plurality of nozzles 111 is aligned in a row rearward from the front side of the nozzle surface 112 along the front and rear direction, and is aligned in a plurality of rows along the right and left direction. As shown in FIG. 3, the plurality of nozzles 111 is divided into four sets of a first nozzle row W1, a second nozzle row W2, a third nozzle row W3, and a fourth nozzle row W4 from the left. The plurality of nozzles 111 corresponds to a plurality of ejection channels (not shown) provided in the head part 110. A plurality of piezoelectric elements (not shown) provided in the head part 110 is driven, so that the plurality of ejection channels can eject downward white ink from the plurality of nozzles 111 corresponding to the plurality of ejection channels. The head unit 100 is placed on the carriage 20 with the nozzle surface 112 facing downward.

Figure 4:
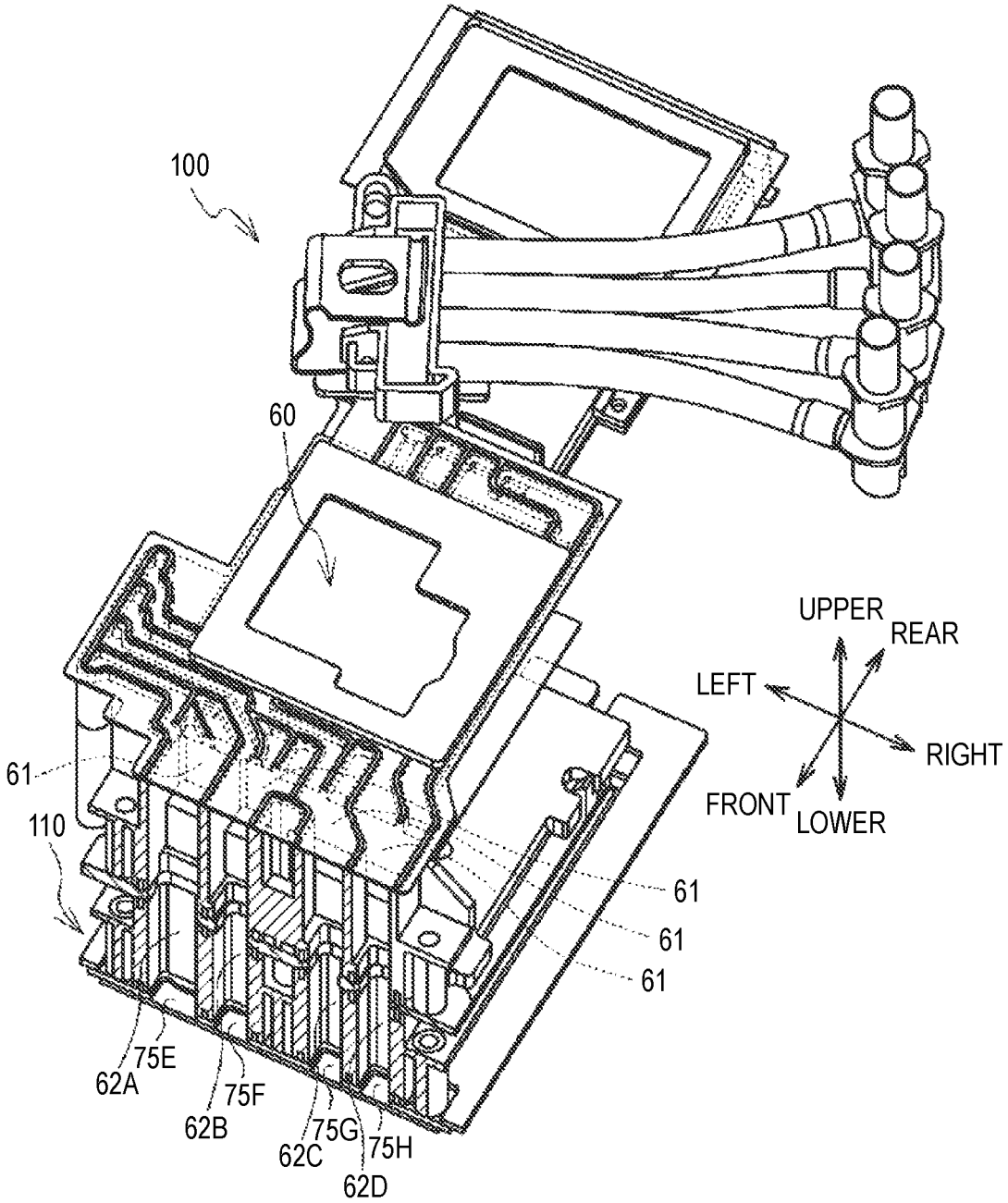
FIG. 4 is a partially cross-sectional area of the head unit 100.

As shown in FIGS. 3 and 4, the buffer tank 60 has a hollow cuboid shape and is formed to extend in parallel to the nozzle surface 112 at an upper part of the head unit 100. The buffer tank 60 is configured to temporarily store ink therein to absorb a pressure fluctuation of the ink supplied to the head part 110, and then to supply the ink to the head part 110. As shown in FIG. 4, the buffer tank 60 includes four storage chambers 61 configured to store ink on the front side, and each storage chamber 61 is connected to each of flow paths 62A, 62B, 62C and 62D facing downward. The flow paths 62A, 62B, 62C and 62D have filters 75E, 75F, 75G and 75H provided at a lower part, respectively. The flow paths 62A to 62D are respectively connected to the manifolds 170A, 180A, 170B and 180B, which will be described later, via the filters 75E to 75H, respectively.

<Structures of Manifolds of First Nozzle Row W1 and Second Nozzle Row W2>

Figure 5:
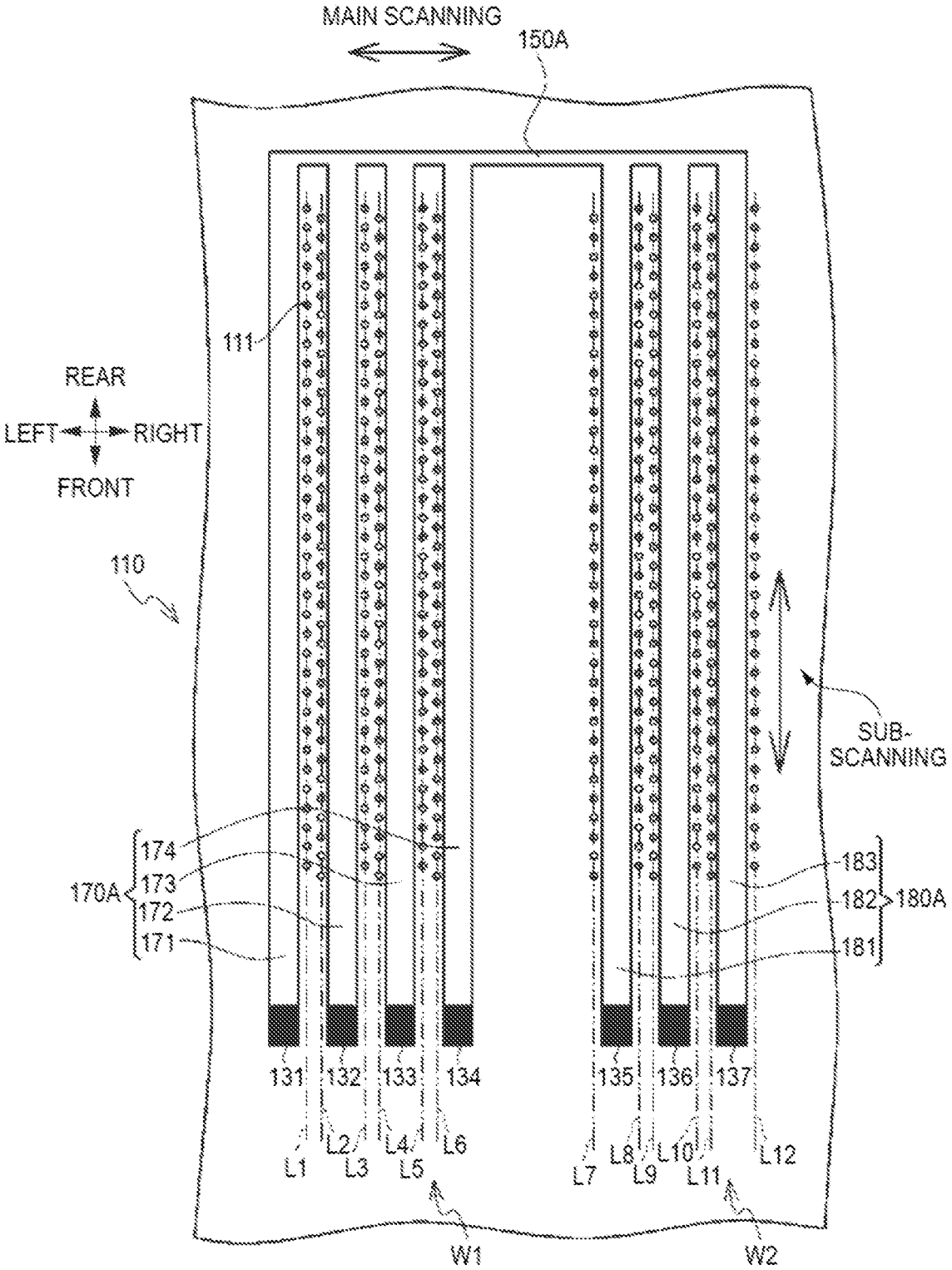
FIG. 5 is a partially cross-sectional view showing nozzles 111 and manifolds 170A and 180A of a head part 110.

Structures of manifolds of the first nozzle row W1 and the second nozzle row W2 are described with reference to FIG. 5. FIG. 5 is a partial cross-sectional view showing structures of manifolds in the head part 110 shown in FIG. 4. In FIG. 5, structures of manifolds of the first nozzle row W1 and the second nozzle row W2 are shown, and the third nozzle row W3 and the fourth nozzle row W4 on the right side of the second nozzle row W2 are omitted. As shown in FIG. 5, the head part 110 has the first nozzle row W1 and the second nozzle row W2. The first nozzle row W1 has a plurality of manifolds 171 to 174 and a plurality of nozzle rows L1 to L6. The second nozzle row W2 has a plurality of manifolds 181 to 183 and a plurality of nozzle rows L7 to L12. The manifold 171 of the first nozzle row W1 is configured to communicate with the nozzles 111 included in the nozzle row L1. The manifold 172 is configured to communicate with the nozzles 111 included in the nozzle rows L2 and L3. The manifold 173 is configured to communicate with the nozzles 111 included in the nozzle rows L4 and L5. The manifold 174 is configured to communicate with the nozzles 111 included in the nozzle rows L6. Respective front end portions of the manifolds 171 to 174 are provided with supply ports 131, 132, 133 and 134, respectively. The supply ports 131 to 134 are connected to the flow path 62A via the filter 75E (refer to FIG. 4), and therefore, can supply the ink 68 to the manifolds 171 to 174, respectively. Hereinafter, the manifolds 171 to 174 are also referred to as 'manifold 170A'.

In addition, the manifold 181 of the second nozzle row W2 is configured to communicate with the nozzles 111 included in the nozzle rows L7 and L8. The manifold 182 is configured to communicate with the nozzles 111 included in the nozzle rows L9 and L10. The manifold 183 is configured to communicate with the nozzles 111 included in the nozzle rows L11 and L12. Respective front end portions of the manifolds 181, 183 and 184 are provided with supply ports 135, 136 and 137, respectively. The supply ports 135 to 137 are connected to the flow path 62B via the filter 75F (refer to FIG. 4), and therefore, can supply the ink 68 to the manifolds 181 to 183, respectively. Hereinafter, the manifolds 181 to 183 are also referred to as 'manifold 180A'. Respective rear end portions of the manifolds 181 to 183 are connected to a left end-side of a communication passage 150A. In addition, respective rear end portions of the manifolds 171 to 174 are connected to a right end-side of the communication passage 150A.

When performing printing on a printing medium, the ink 68 is supplied from the supply ports 131 to 137 to the manifolds 171 to 174 and 181 to 183, respectively, and is ejected from the nozzle rows L1 to L12, as described above. In addition, during head circulation of the ink 68, which will be described later, the ink 68 flows from one side to the other side of the first nozzle row W1 and the second nozzle row W2. For example, the ink 68 flows from the supply ports 131 to 134 to the manifolds 171 to 174, respectively, and the ink 68 flows to the manifolds 181 to 183 via the communication passage 150A and returns to the supply ports 135 to 137. Therefore, during the head circulation of the ink 68, the manifolds 171 to 174, the communication passage 150A, and the manifolds 181 to 183 form a circulation flow path of the ink 68 in the head part 110. The flow paths 62A to 62D, the manifolds 171 to 174 and 181 to 183 and the communication passage 150A in the head part 110 are narrower and more complicated in structure than flow paths 714C, 715C and 802 (refer to FIG. 6) outside the head part 110, which will be described later. Therefore, a flow path resistance inside the head part 110 is greater than a flow path resistance outside the head part 110. Note that, the structure is similar to the flow path for supplying the ink 68 to the third nozzle row W3 and the fourth nozzle row W4.

<Ink Supply Units 700A and 700B>

Figure 6:
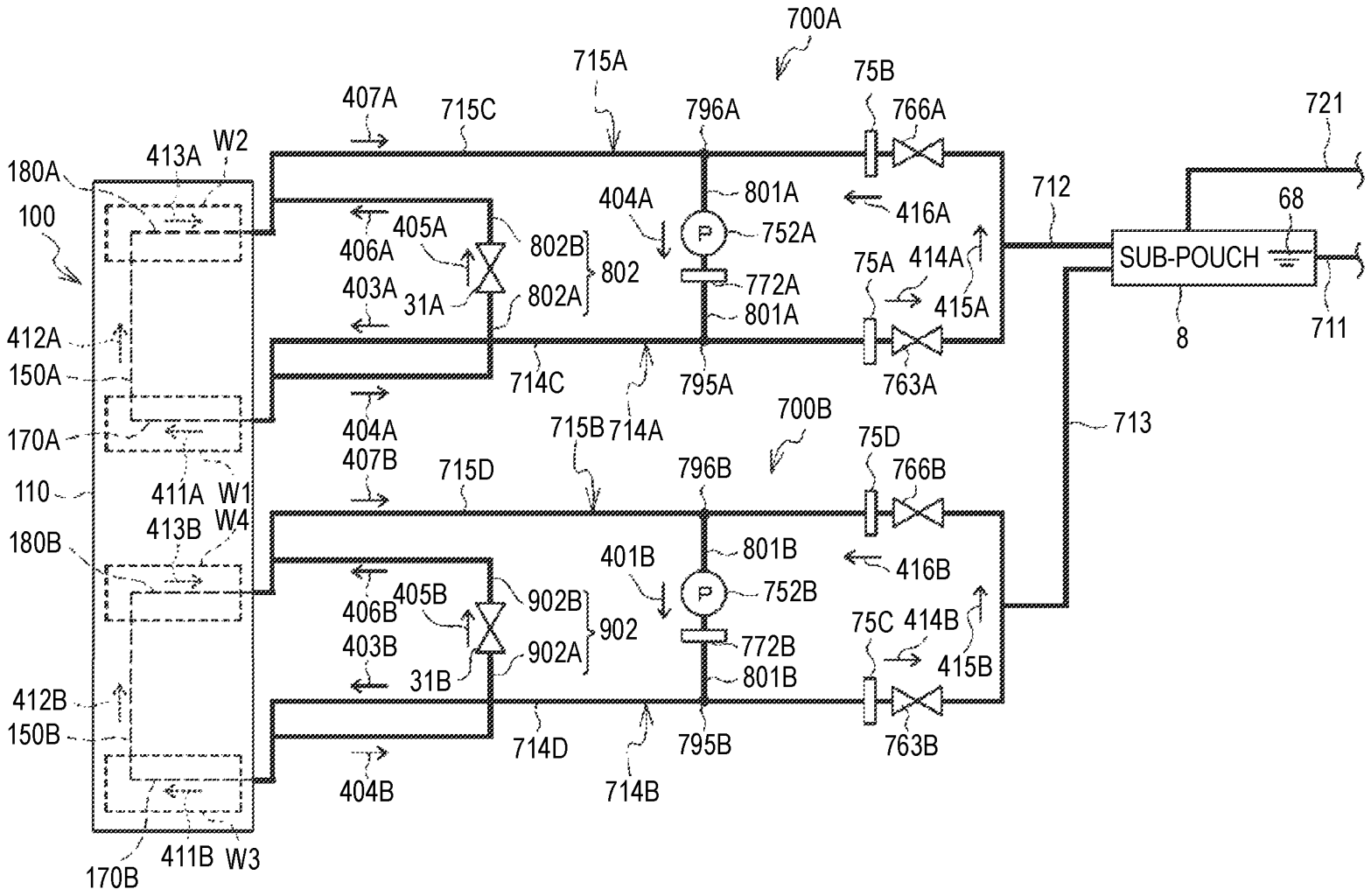
FIG. 6 shows a flow path configuration of ink 68 of the printer 1.

As shown in FIG. 6, ink supply units 700A and 700B are parts where the ink 68 is supplied from a sub-pouch 8 to the head part 110 and the ink 68 circulates. As an example, the sub-pouch 8 has a flexible bag shape and is configured to accommodate the ink 68 supplied from a main tank (not shown) of white ink. In addition, the sub-pouch 8 is connected to the main tank (not shown) of white ink by a first flow path 711. The ink 68 in the sub-pouch 8 is circulated to the main tank through a circulation flow path 721. The sub-pouch 8 is connected to the ink supply unit 700A via a second flow path 712, and is connected to the ink supply unit 700B via a third flow path 713.

The ink supply unit 700A includes a fourth flow path 714A, a fifth flow path 715A, a first bypass flow path 801A, a second bypass flow path 802A, a second bypass flow path 802B, a pump 752A, electromagnetic valves 31A, 763A and 766A, and filters 75A, 75B and 772A. Hereinafter, the second bypass flow path 802A and the second bypass flow path 802B are collectively referred to as 'second bypass flow path 802' unless there is need to make a distinction. As shown in FIG. 6, one end of the manifold 170A of the head part 110 is connected to the flow path 62A, and the other end is connected to the communication passage 150A. One end of the manifold 180B is connected to the flow path 62B, and the other end is connected to the communication passage 150B. Since a flow path of the fourth flow path 714A(714C), which is in the head part 110, is the flow path 62A, the fourth flow path 714A(714C) is connected to the manifold 170A and supplies the ink 68 to the manifold 170A. Since a flow path of the fifth flow path 715A(715C), which is in the head part 110, is the flow path 62B, the fifth flow path 715A (715C) is connected to the manifold 180A and supplies the ink 68 to the manifold 180A. A relationship between the manifolds 170B and 180B and the fourth flow path 714B and fifth flow path 715B is similar to a relationship between the manifolds 170A and 180A and the fourth flow path 714A and fifth flow path 715A.

As shown in FIG. 6, the second flow path 712 is connected to the sub-pouch 8, the fourth flow path 714A and the fifth flow path 715A, and is configured to supply the ink 68 from the sub-pouch 8 to the fourth flow path 714A and the fifth flow path 715A. The third flow path 713 is connected to the sub-pouch 8, the fourth flow path 714B and the fifth flow path 715B, and is configured to supply the ink 68 from the sub-pouch 8 to the fourth flow path 714B and the fifth flow path 715B. The fourth flow path 714A has the electromagnetic valve 763A and the filter 75A. The electromagnetic valve 763A is configured to be controlled by a CPU 11 (refer to FIG. 8), thereby opening and closing the fourth flow path 714A. The fifth flow path 715B has the electromagnetic valve 766A and the filter 75B. The electromagnetic valve 766A is configured to be controlled by the CPU 11, thereby opening and closing the fifth flow path 715A.

The first bypass flow path 801A is configured to connect the fourth flow path 714A and the fifth flow path 715A each other outside the head part 110. For example, the first bypass flow path 801A is configured to connect the fourth flow path 714A and the fifth flow path 715A each other downstream of the filters 75A and 75B. The first bypass flow path 801A has the filter 772A and the pump 752A. The filter 772A is provided on the fourth flow path 714A-side with respect to the pump 752A. Note that, a side, which is downstream of a connection place with the bypass flow path 801A, of the fourth flow path 714A is referred to as a fourth flow path 714C. In addition, a side, which is downstream of the connection place with the bypass flow path 801A, of the fifth flow path 715A is referred to as a fifth flow path 715C. The fifth flow path 715C functions as a circulation flow path of the ink 68 during circulation processing of ink, which will be described later.

On the head part 110-side with respect to the first bypass flow path 801A, the fourth flow path 714A and the fifth flow path 715A are connected via the second bypass flow path 802. The second bypass flow path 802 has the electromagnetic valve 31A. The electromagnetic valve 31A is configured to be controlled by the CPU 11, thereby opening and closing the second bypass flow path 802. A flow path, which is between the electromagnetic valve 31A and the fourth flow path 714C, of the second bypass flow path 802 is referred to as 'second bypass flow path 802A', and a flow path, which is between the electromagnetic valve 31A and the fifth flow path 715C, of the second bypass flow path 802 is referred to as 'second bypass flow path 802B'.

The ink supply unit 700B has a configuration similar to the ink supply unit 700A, and includes a fourth flow path 714B, a fifth flow path 715B, a first bypass flow path 801B, a second bypass flow path 902A, a second bypass flow path 902B, a pump 752B, electromagnetic valves 31B, 763B and 766B, and filters 75C, 75D and 772B. Hereinafter, the second bypass flow path 902A and the second bypass flow path 902B are collectively referred to as 'second bypass flow path 902' unless there is need to make a distinction. The head part 110 further includes a third nozzle row W3 and a fourth nozzle row W4 for ejecting white ink, a communication passage 170B, a manifold 170B and a manifold 180B. One end of the manifold 170B is connected to the flow path 62C, and the other end is connected to the communication passage 150B. One end of the manifold 180B is connected to the flow path 62D, and the other end is connected to the communication passage 150B.

The fourth flow path 714B is connected to the third flow path 713 and the manifold 170B, and is configured to supply the ink 68 to the manifold 170B. The manifold 170B is configured to supply the ink 68 to the nozzles 111 (refer to FIG. 3) of the third nozzle row W3. The fifth flow path 715B is connected to the third flow path 713 and the manifold 180B, and is configured to supply the ink 68 to the manifold 180B. The manifold 180B is configured to supply the ink 68 to the nozzles 111 (refer to FIG. 4) of the fourth nozzle row W4.

The fourth flow path 714B has the electromagnetic valve 763B and the filter 75C. The electromagnetic valve 763B is configured to be controlled by the CPU 11, thereby opening and closing the fourth flow path 714B. The fifth flow path 715B has the electromagnetic valve 766B and the filter 75D. The electromagnetic valve 766B is configured to be controlled by the CPU 11, thereby opening and closing the fifth flow path 715B.

The first bypass flow path 801B is configured to connect the fourth flow path 714B and the fifth flow path 715B each other. For example, the first bypass flow path 801B is configured to connect the fourth flow path 714B and the fifth flow path 715B each other, downstream of the filters 75C and 75D. The bypass flow path 801B has the filter 772B and the pump 752B. The filter 772B is provided on the fourth flow path 714B-side with respect to the pump 752B. Note that, a side, which is downstream of a connection place with the first bypass flow path 801B, of the fourth flow path 714B is referred to as a fourth flow path 714D. In addition, a side, which is downstream of the connection place with the first bypass flow path 801B, of the fifth flow path 715B is referred to as a fifth flow path 715D. The fifth flow path 715D functions as a circulation flow path of the ink 68 during circulation processing of ink, which will be described later.

In addition, on the head part 110-side, the fourth flow path 714B and the fifth flow path 715B are connected via the second bypass flow path 902. The second bypass flow path 902 has the electromagnetic valve 31B. The electromagnetic valve 31 is configured to be controlled by the CPU 11, thereby opening and closing the second bypass flow path 902. A flow path, which is between the electromagnetic valve 31B and the fourth flow path 714D, of the second bypass flow path 902 is referred to as 'second bypass flow path 902A', and a flow path, which is between the electromagnetic valve 31B and the fifth flow path 715D, of the second bypass flow path 902 is referred to as 'second bypass flow path 902B'. Note that, although the flow paths 62A to 62D and the filters 75E to 75H shown in FIG. 4 are not shown in FIG. 6, the positions where they are provided are parts of the fourth flow paths 714A and 714B and the fifth flow paths 715A and 715B connected to the manifolds 170A, 180A, 170B and 180B, in the head part 110.

<Cleaning Liquid Supply Unit 120>

Figure 7:
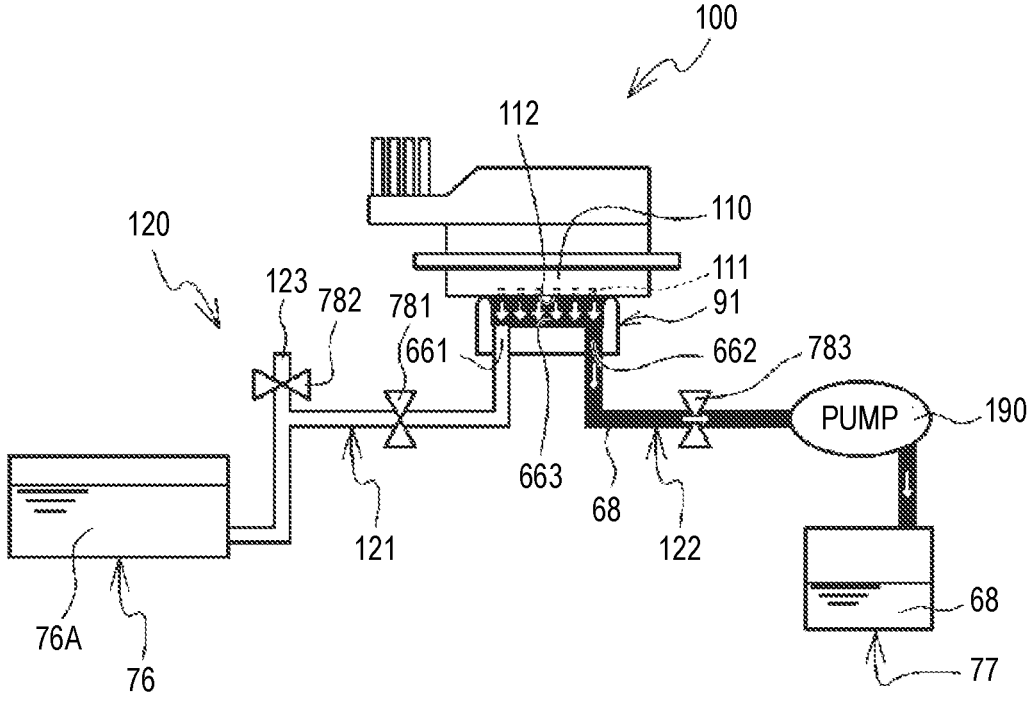
FIG. 7 is a flow path diagram of a cleaning liquid 76A and the ink 68.

A cleaning liquid supply unit 120 shown in FIG. 7 is provided in the printer 1, and includes a cleaning liquid bottle 76, a cleaning liquid flow path 121, a drainage flow path 122, a suction pump 190, and a drainage tank 77. The cleaning liquid bottle 76 is configured to accommodate the cleaning liquid 76A. The cleaning liquid flow path 121 is configured to connect the cleaning liquid bottle 76 and a supply hole 661 of the cap 91 and to supply the cleaning liquid 76A to an inside 663 of the cap 91. In addition, the cleaning liquid flow path 121 has an atmospheric opening port 123, an electromagnetic valve 781, and an electromagnetic valve 782. The electromagnetic valve 782 is configured to open and close the atmosphere opening port 123. The electromagnetic valve 781 is configured to open and close the cleaning liquid flow path 121. The drainage flow path 122 is configured to connect an exhaust hole 662 of the cap 91 and the drainage tank 77. In addition, the drainage flow path 122 has an electromagnetic valve 783 and the suction pump 190. The electromagnetic valve 783 is configured to open and close the drainage flow path 122. The suction pump 190 is configured to suck the air, ink 68 and cleaning liquid 76A in the drainage flow path 122 and the cap 91 and to discharge the same to the drainage tank 77.

<Electrical Configuration of Printer 1>

Figure 8:
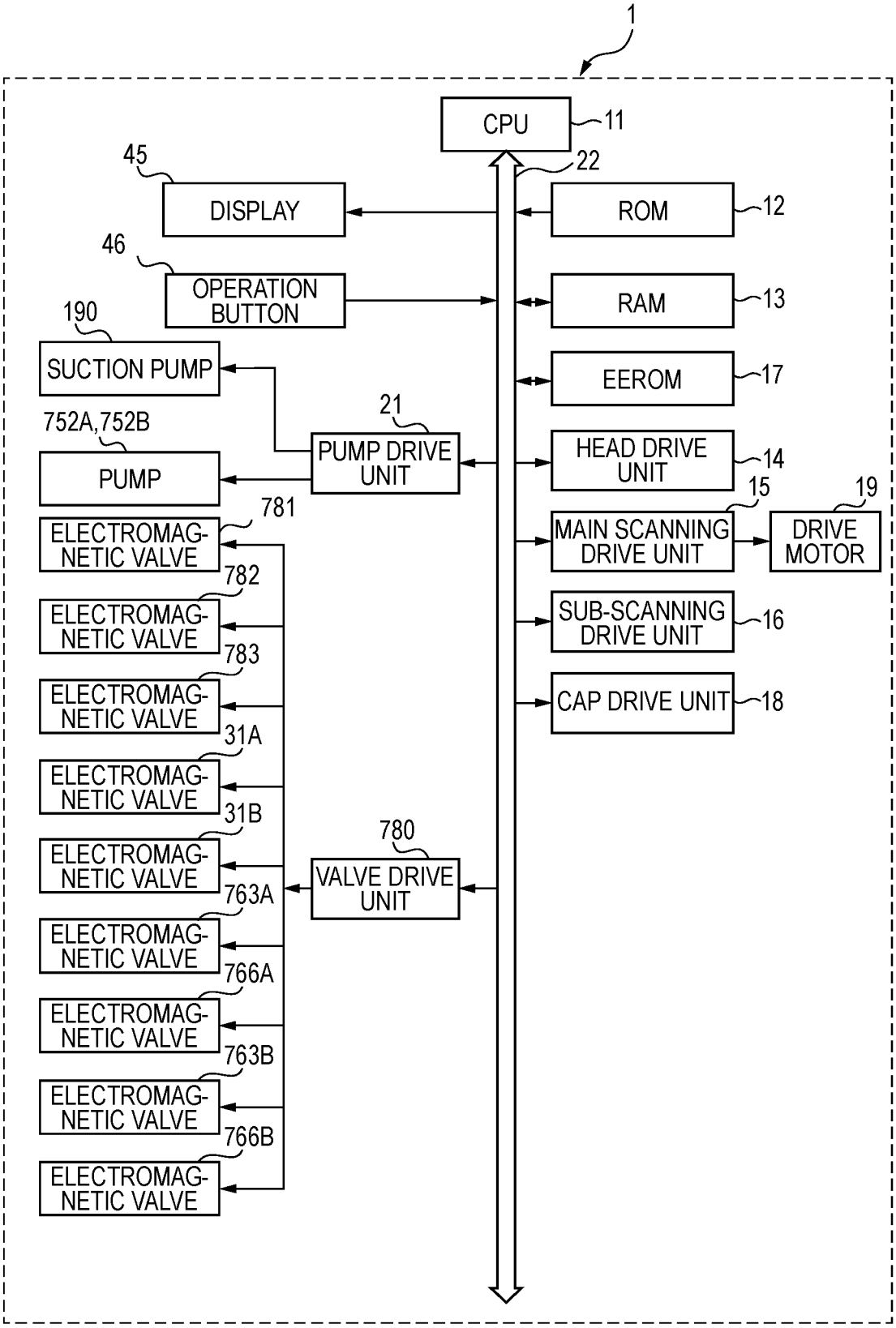
FIG. 8 is a block diagram showing an electrical configuration of the printer 1.

As shown in FIG. 8, the printer 1 includes the CPU 11 responsible for control of the printer 1. The CPU 11 is electrically connected to a ROM 12, a RAM 13, a head drive unit 14, a main scanning drive unit 15, a sub-scanning drive unit 16, an EEPROM 17, a cap drive unit 18, a display 45, an operation button 46, a pump drive unit 21 and a valve drive unit 780 via a bus 22.

The ROM 12 is configured to store a control program, initial values, and the like for the CPU 11 to control an operation of the printer 1. The RAM 82 is configured to temporarily store a variety of data that are used for the control program. The EEPROM 17 is a non-volatile memory, and is configured to store a time at which printing processing (S1), which will be described later, ends, and the like. The head drive unit 14 is electrically connected to the head part 110 configured to eject ink, and is configured to drive a piezoelectric element provided in each ejection channel of the head part 110 (refer to FIGS. 3 and 4) to eject ink from the nozzles 111.

The main scanning drive unit 15 is connected to the drive motor 19 and is configured to move the carriage 20 in the right and left direction (main scanning direction). The sub-scanning drive unit 16 includes a motor, a gear, and the like (not shown), and is configured to drive the platen drive mechanism 6 (refer to FIG. 1) to move the platen 5 in the front and rear direction (sub-scanning direction).

The cap drive unit 18 includes a cap drive motor (not shown), a gear, and the like, and is configured to move the cap support part 92 shown in FIG. 2 in the upper and lower direction to move the cap 91 in the upper and lower direction. The display 45 is configured to display a variety of information. An input from the operation button 46 is input to the CPU 11. The pump drive unit 21 is configured to drive and control the suction pump 190, the pump 752A and the pump 752B. The valve drive unit 780 is configured to drive and control the electromagnetic valves 781, 782, 783, 784, 31A, 31B, 763A, 766A, 763B and 766B.

<Liquid-Contact Circulation Processing>

Liquid-contact circulation processing is described with reference to FIGS. 6 to 15. In the printer 1, circulation of the ink 68 is performed at regular intervals for purposes of removing air bubbles in the ink 68 and eliminating sedimentation of ink components such as pigment in the flow path of the ink 68. In this case, in order to further remove air bubbles and eliminate sedimentation of ink components, when a circulation speed of the ink 68 is increased and circulation of the ink 68 is performed, a meniscus of the nozzle 111 may be destroyed. When the meniscus is destroyed, a malfunction such as introduction of air bubbles into the head part 110 from the nozzle 111 or outflow of the ink 68 from the nozzle 111 may occur. Therefore, it is considered to perform liquid-contact circulation so as to increase the circulation speed of the ink 68 and to perform circulation of the ink 68 while reducing the possibility of occurrence of the malfunction. In the liquid-contact circulation, the ink 68 is circulated, for example, through the first bypass flow path 801A, the fourth flow path 714C, the manifold 170A, the communication passage 150A, the manifold 180A and the fifth flow path 715C, in a state where the cap 91 is closely contacted with the nozzle surface 112 so as to cover the nozzles 111 and the cap 91 is filled with the cleaning liquid 76A. Since the cap 91 is close to the nozzles 111, if a time of the liquid-contact state is long, the ink 68 may flow from the nozzles 111 into the cap 91 and the ink 68 may remain in the cap 91. In this case, agglomerates (resin component) of the ink 68 may block the flow path through which the ink 68 flows, such as the drainage flow path 122. In this case, the purge is performed as a return operation before start of printing, but the drainage flow path 122 may be clogged and the efficiency of purge by the suction pump 190 may decrease. Further, in a case where the cap 91 is provided with a member called a foam (not shown) containing a moisturizing liquid so as to reduce the drying of the ink 68 in the nozzles 111, a moisturizing effect of the foam is weakened. Therefore, in the present embodiment, in order to reduce a possibility of occurrence of the malfunctions, liquid-contact circulation processing of reducing circulation of the ink in the liquid-contact state and reducing the ink that is to flow into the cap 91 is performed. This is described below.

For example, when a power supply of the printer 1 becomes on, the CPU 11 reads out a program of main processing (not shown) for performing main control such as a printing operation of the printer 1, a program of liquid-contact circulation processing (refer to FIGS. 9A and 9B), and the like from the ROM 12, and develops the programs onto the RAM 13. The CPU 11 executes the main processing and the liquid-contact circulation processing according to the programs.

Figures 9, 9A:
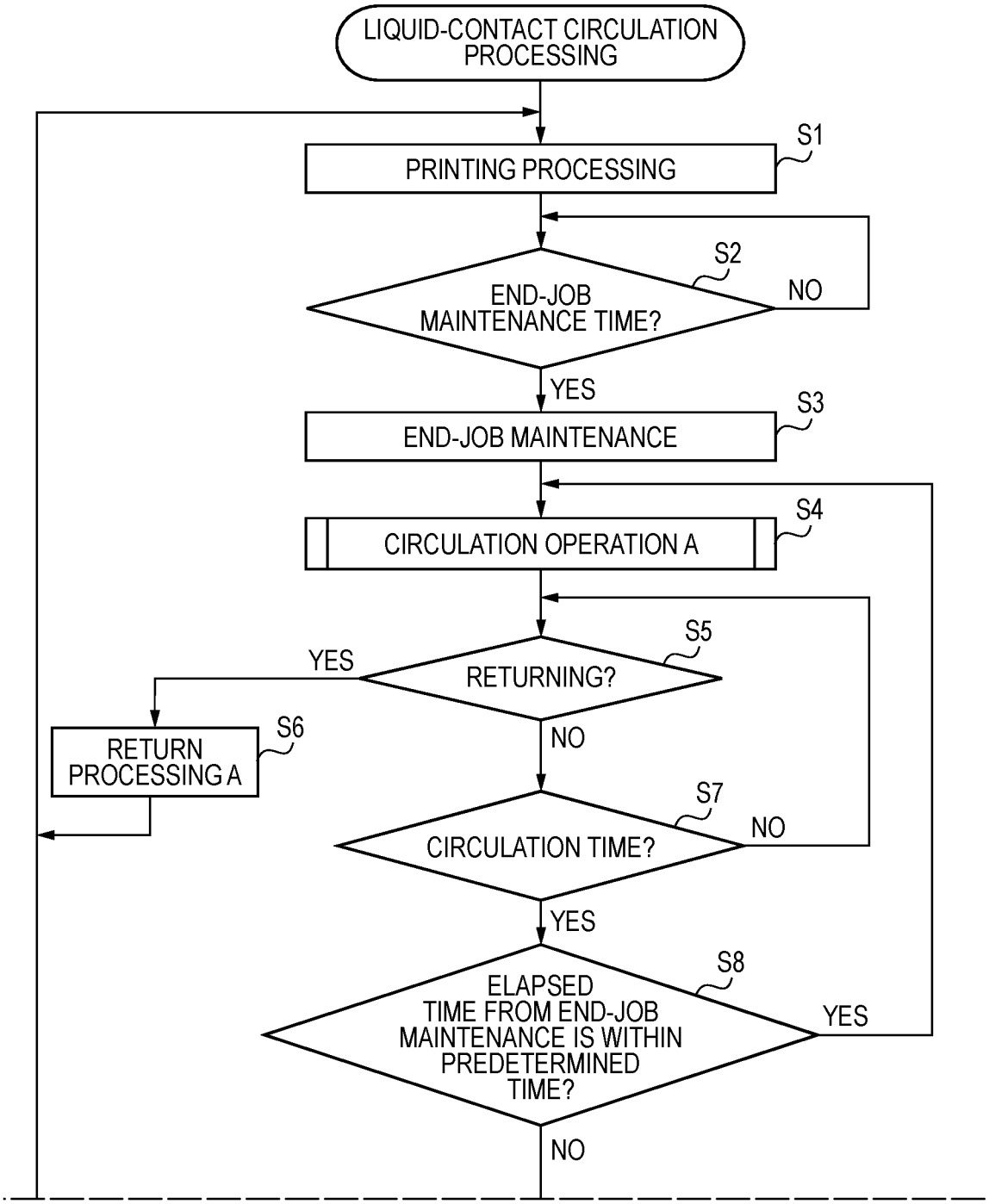
FIGS. 9A and 9B are flowcharts of liquid-contact circulation processing.
Figure 9B:
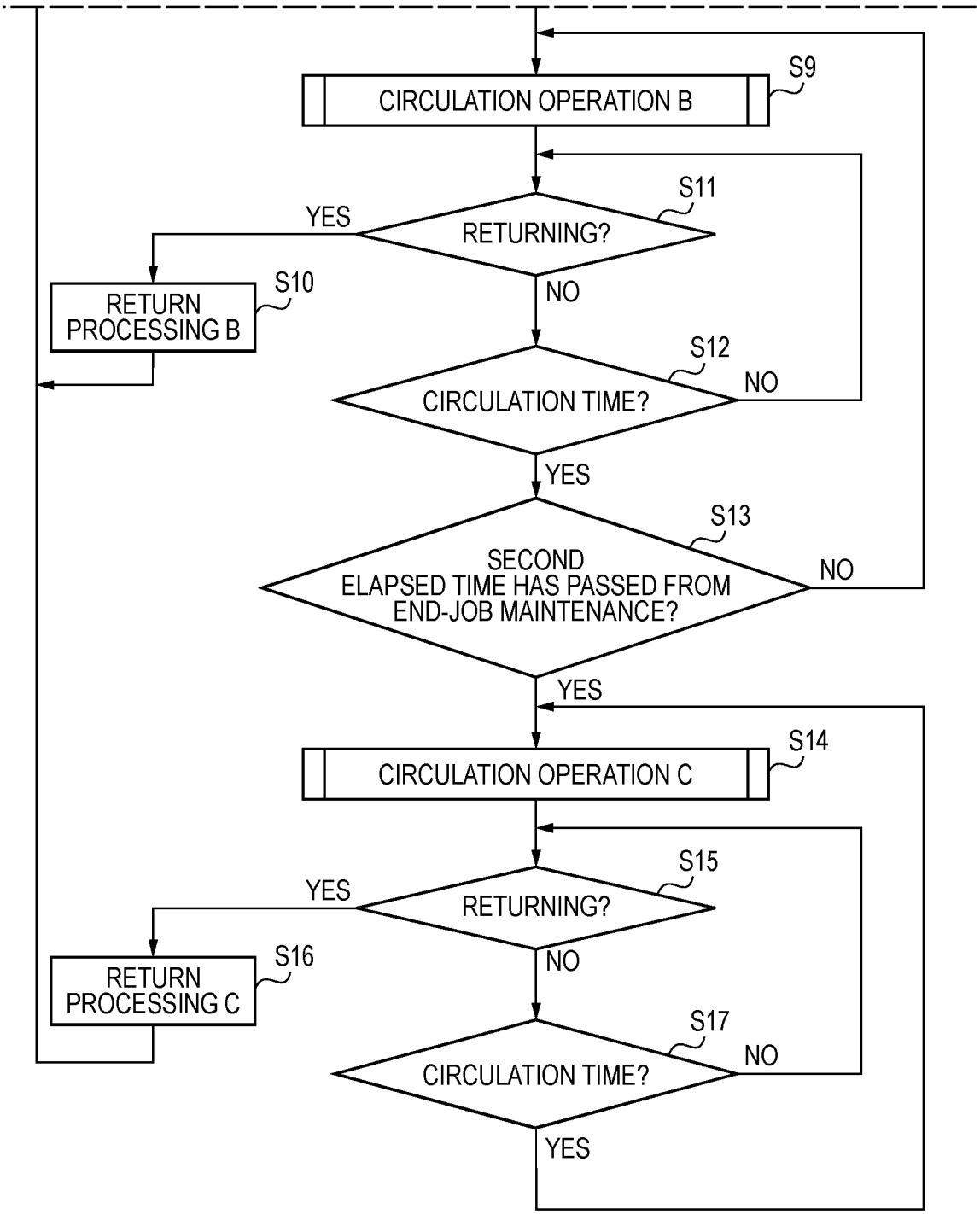

As shown in FIGS. 9A and 9B, when printing processing (S1) ends, the CPU 11 raises the cap 91 by the cap drive unit 18 and brings the cap 91 into contact with the nozzle surface 112 of the head part 110 so as to prevent the nozzles 111 from drying. Then, the CPU 11 stores an end time in the EEPROM 17 (S1). Next, the CPU 11 determines whether it is an end-job maintenance time (S2). The end-job maintenance time is a predetermined time and is a time at which an end-job maintenance, which will be described later, is performed. For example, the end-job maintenance time is 8:00 p.m. When it is not determined that it is the end-job maintenance time (S2: NO), the CPU 11 continues the determination of S2. When it is determined that it is the end-job maintenance time (S2: YES), the CPU performs end-job maintenance (S3).

Figure 11:
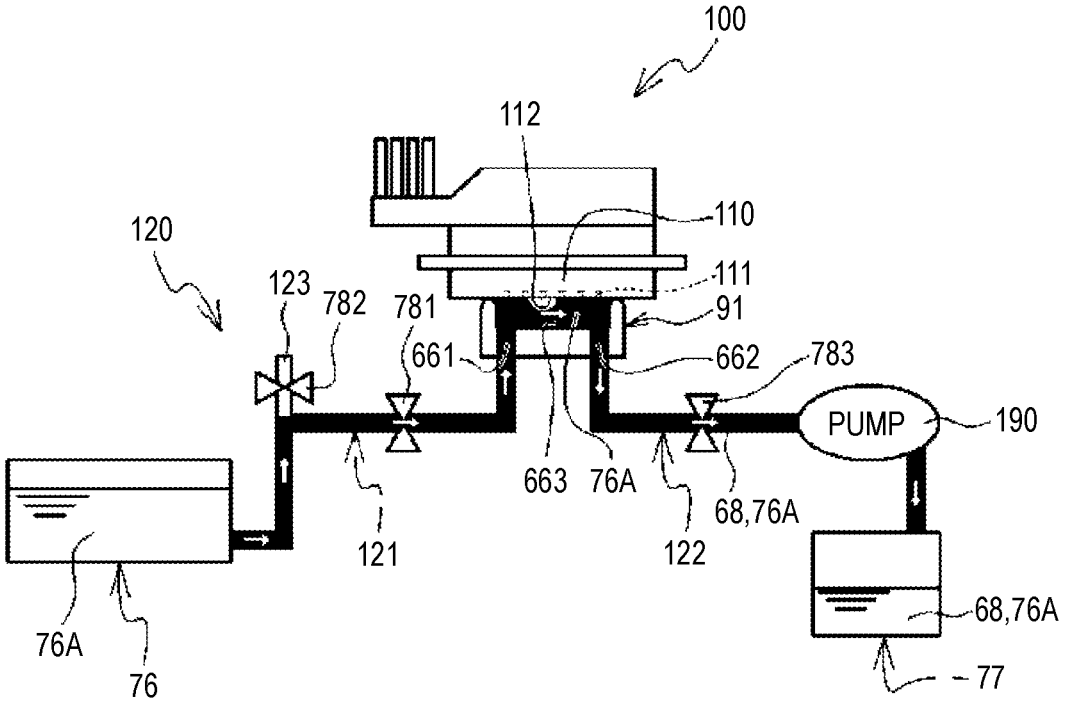
FIG. 11 is a flow path diagram showing a liquid-contact state.

An example of the end-job maintenance is described with reference to FIGS. 7 and 11. The cap 91 is in a state of being in contact with the nozzle surface 112. The CPU 11 closes the electromagnetic valve 781 and opens the electromagnetic valve 783. Next, the CPU 11 drives the suction pump 190 for a certain time. The insides of the drainage flow path 122 and the cap 91 become a negative pressure, and the CPU 11 executes the purge in which ink is sucked from the nozzles 111 of the head part 110, as shown in FIG. 7. Next, the CPU 11 opens the electromagnetic valve 781 and closes the electromagnetic valve 782. The electromagnetic valve 783 remains open. Next, the CPU 11 drives the suction pump 190. The insides of the drainage flow path 122, the cap 91, and the cleaning liquid flow path 121 become a negative pressure, and as shown in FIG. 11, the cleaning liquid 76A flows from the cleaning liquid bottle 76 to the cleaning liquid flow path 121, the electromagnetic valve 781, and the cap 91. In the liquid-contact state, the cleaning liquid 76A cleans the inside of the cap 91 and the nozzle surface 111, and the overflowing cleaning liquid 76A is discharged from the drainage flow path 122 to the drainage tank 77. Thereafter, the CPU 11 stops the suction pump 190 and closes the electromagnetic valve 781 and the electromagnetic valve 783. Therefore, the inside of the cap 91 is filled with the cleaning liquid, and the state in which the cleaning liquid 76A is in contact with the nozzle surface 112 is maintained. The CPU 11 stores an end time of the end-job maintenance in the EEPROM 17 (S3).

<Circulation Operation A>

Next, the CPU 11 executes a circulation operation A (S4). As the circulation operation A, in first circulation processing, the CPU 11 performs head-inside circulation, which will be described later, for the first nozzle row W1 and the second nozzle row W2, and does not perform the head-inside circulation for the third nozzle row W3 and the fourth nozzle row W4. Since the filter 772A is provided on a downstream side with respect to a direction in which the pump 752A delivers the ink 68, a zero point of a pressure at which the positive pressure due to the delivery of the ink 68 from the pump 752A and the negative pressure due to the suction of the ink 68 of the pump 752A are balanced is moved to the manifold 170A-side of the first nozzle row W1 with respect to a center of the communication passage 150A. As a result, a negative pressure is generated in the nozzles 111 of the first nozzle row W1 and the second nozzle row W2. However, actually, a suction capability of the pump 752A to suck the ink 68 cannot create an absolute vacuum due to the structure of the pump 752A, and is specified to a predetermined value. In contrast, a delivery capability of the pump 752A to deliver the ink 68 can be made higher than the suction capability by increasing a number of rotations of the pump 752A. Therefore, in the head circulation, when the number of rotations of the pump 752A is increased, the flow path resistances of the manifold 170A, the communication passage 150A, and the manifold 180A of the head part 110 are large, so that the suction capability of the pump 752A cannot catch up with the delivery capability, the zero point of the pressure is moved to the manifold 180A-side and the positive pressure may be thus generated in the nozzles 111 of the first nozzle row W1 and the second nozzle row W2. In head-outside circulation such as bypass circulation and filter circulation (which will be described later) in which the ink 68 does not circulate in the head part 110 having a large flow path resistance but circulates through a flow path outside the head part 110, the flow path resistance of the flow path through which the ink 68 passes is much smaller, as compared to the head-inside circulation. Therefore, a load that is applied to the pump 752B is reduced, and the suction capability of the pump 752B is not reduced. Further, in the head-outside circulation, the ink 68 can be circulated through the bypass flow paths 802 and 902, the fourth flow path 714A, and the fifth flow path 715A, which are farther apart from the nozzles 111, as compared to the head-inside circulation. Therefore, the zero point of the pressure is on the manifold 170A-side, and a negative pressure is applied to the nozzles 111. That is, in the head-outside circulation, the positive pressure that is applied to the nozzles 111 is reduced, as compared to the head circulation. The same applies to the third nozzle row W3-side and the fourth nozzle row W4-side. In the present disclosure, the CPU 11 reduces the positive pressure, which is generated in the cap 91, by executing, in the ink supply units 700A and 700B, the head circulation on one side and executing the head-outside circulation or not executing circulation on the other side, without executing the head circulation at the same time. Hereinafter, the circulation operation A is described with reference to a sub-routine shown in FIG. 10. First, the CPU 11 resets a counter n configured to count numbers of execution times of first circulation processing (S42) and second circulation processing (S43), as 'n=0' (S41).

<First Circulation Processing>

Next, the CPU 11 executes first circulation processing (S42). As the first circulation processing, the CPU 11 performs head-inside circulation, which will be described later, for the first nozzle row W1 and the second nozzle row W2 for a predetermined time. In addition, as the first circulation processing, the CPU 11 performs bypass circulation, which will be described later, for the third nozzle row W3 and the fourth nozzle row W4 for a predetermined time.

<Head-Inside Circulation of First Nozzle Row W1 and Second Nozzle Row W2 In First Circulation Processing>

The head-inside circulation of the first nozzle row W1 and the second nozzle row W2 in the first circulation processing is described with reference to FIG. 6. The CPU 11 closes the electromagnetic valve 763A, the electromagnetic valve 766A, and the electromagnetic valve 31A of the ink supply unit 700A. Next, the CPU 11 drives the pump 752A at a predetermined rotation speed for a predetermined time. Therefore, the ink 68 flows from the pump 752A through the first bypass flow path 801A in a direction of an arrow 401A and through the fourth flow path 714C in a direction of an arrow 403A. Since the electromagnetic valve 31A is closed, the ink 68 flows through the manifold 170A, the communication passage 150A, and the manifold 180A of the head part 110 in directions of arrows 411A, 412A and 413A. Next, the ink 68 flows through the fifth flow path 715C in a direction of an arrow 407A and flows into the first bypass flow path 801A. The ink 68 flowing into the first bypass flow path 801A flows from the pump 752A in the direction of the arrow 401A and circulates in a similar manner to described above. The CPU 11 stops the pump 752A after performing the head-inside circulation of the ink 68 for a predetermined time.

<Circulation Other Than Head-Inside Circulation of Third Nozzle Row W3 and Fourth Nozzle Row W4 In First Circulation Processing>

Circulation other than the head-inside circulation of the third nozzle row W3 and the fourth nozzle row W4 is described with reference to FIG. 6. The circulation other than the head-inside circulation of the third nozzle row W3 and the fourth nozzle row W4 is circulation in which the ink 68 does not circulate through the fourth flow path 714D, the manifold 170B, the communication passage 150B, the manifold 180B, and the fifth flow path 715D. For example, the CPU 11 closes the electromagnetic valves 763B and 766B of the ink supply unit 700B and opens the electromagnetic valves 31B. Next, the CPU 11 drives the pump 752B at a predetermined number of rotations for a predetermined time. The ink 68 flows from the pump 752B through the first bypass flow path 801A in a direction of an arrow 401B and through the fourth flow path 714D in a direction of an arrow 403B. As described above, the flow path resistances of the manifold 170B, the communication passage 150B and the manifold 180B are greater than those of the second bypass flow paths 902A and 902B. Therefore, the ink 68 flows through the second bypass flow path 902A in a direction of an arrow 404B. Next, the ink 68 flows through the electromagnetic valve 31B in a direction of an arrow 405B, through the second bypass flow path 902B in a direction of an arrow 406B and through the fifth flow path 715D in a direction of an arrow 407B, and flows into the first bypass flow path 801B. The ink 68 flowing into the first bypass flow path 801B flows from the pump 752B in the direction of the arrow 401B and circulates in a similar manner to described above. This circulation is called bypass circulation. The CPU 11 stops the pump 752B after performing the bypass circulation of the ink 68 for a predetermined time. In the first circulation processing, the CPU 11 simultaneously executes, for example, the head-inside circulation and the bypass circulation. For example, the CPU 11 may start the rotation of the pump 752A in the head circulation and the rotation of the pump 752B in the bypass circulation at the same time, rotate the pumps at the same rotation speed for a predetermined time, and end the rotations at the same time. In addition, the CPU 11 may make the rotation speed of the pump 752A slower than the rotation speed of the pump 752B, and make the circulation speed of the ink 68 in the head circulation slower than the circulation speed of the ink 68 in the bypass circulation. Further, the CPU 11 may cause the pump 752A to perform intermittent driving that repeats drive for a predetermined time and stop for a predetermined time. Further, the CPU 11 may start the head circulation later than the bypass circulation by driving the pump 752A for performing the head circulation after driving the pump 752B for performing the bypass circulation. Further, the CPU 11 may end the head circulation earlier than the circulation other than the head circulation, such as the bypass circulation, by stopping the drive of the pump 752A for performing the head circulation earlier than stopping the drive of the pump 752B for performing the bypass circulation.

<Second Circulation Processing>

Next, the CPU 11 executes second circulation processing (S43). As the second circulation processing, the CPU 11 performs the bypass circulation as an example of the circulation other than the head-inside circulation for the first nozzle row W1 and the second nozzle row W2 for a predetermined time, and performs the head-inside circulation for the third nozzle row W3 and the fourth nozzle row W4 for a predetermined time.

<Bypass Circulation of Ink Supply Unit 700A in Second Circulation Processing>

The circulation other than the head-inside circulation of the first nozzle row W1 and the second nozzle row W2 is circulation where the ink 68 does not circulate through the fourth flow path 714C, the manifold 170A, the communication passage 150A, the manifold 180A, and the fifth flow path 715C, and is, for example, the bypass circulation. The CPU 11 executes bypass circulation in the ink supply unit 700A. Since the bypass circulation in the ink supply unit 700A is similar to the bypass circulation in the ink supply unit 700B described above, the description thereof is omitted.

<Head-Inside Circulation on Ink Supply Unit 700B-side in Second Circulation Processing>

The head-inside circulation of the third nozzle row W3 and the fourth nozzle row W4 in the second circulation processing is described. The CPU 11 executes head circulation in the ink supply unit 700B. Since the head circulation in the ink supply unit 700B is similar to the head circulation in the ink supply unit 700A described above, the description thereof is omitted.

Next, the CPU 11 sets the counter n=n+1 (S44). Therefore, n=1. The CPU 11 determines whether n≥3 (S45), and when the CPU 11 does not determine n≥3 (S45: NO), the CPU advances the processing to S42, and repeats the processing of S42 to S45 in a similar manner to described above. When three sets of the first circulation processing and the second circulation processing are executed, n=3, and therefore, the CPU 11 determines n≥3 (S45: YES). Next, the CPU 11 performs three sets of filter circulation processing in the ink supply units 700A and 700B (S46).

<Filter Circulation>

The filter circulation in the ink supply unit 700A is described with reference to FIG. 6. The CPU 11 opens the electromagnetic valve 763A and the electromagnetic valve 766A and closes the electromagnetic valve 31A of the ink supply unit 700A. Next, the CPU drives the pump 752A for a predetermined time. The ink 68 flows from the pump 752A through the first bypass flow path 801B in the direction of the arrow 401B. The flow path resistances of the manifold 170A, the communication passage 150A and the manifold 180A are greater than those of the fourth flow path 714A and the fifth flow path 715A. Therefore, the ink 68 flows through the fourth flow path 714A in a direction of an arrow 414A, rather than in the direction of the manifold 170A, the communication passage 150A and the manifold 180A. Therefore, the ink 68 flows through the filter 75A and the electromagnetic valve 763A in the direction of the arrow 414A, flows through the fifth flow path 715A in a direction of an arrow 416A, flows through the electromagnetic valve 766A and the filter 75B, and flows into the first bypass flow path 801A. The ink 68 flowing into the first bypass flow path 801A flows from the pump 752A in the direction of the arrow 401A and circulates in a similar manner to described above. The CPU 11 stops the pump 752B after performing the filter circulation of the ink 68 for a predetermined time. Since the filter circulation in the ink supply unit 700B is similar to the filter circulation in the ink supply unit 700A, the description thereof is omitted.

After executing three sets of the above-described filter circulation, the CPU 11 returns the processing to the liquid-contact circulation processing of FIGS. 9A and 9B, and determines whether the processing is returned from the liquid-contact state (S5). The CPU 11 determines as returning, when a printing instruction is input from the operation button 46 (refer to FIG. 8) or when a printing instruction is input from a terminal apparatus (not shown) such as a computer connected to the printer 1 (S5: YES). Further, the CPU 11 also determines as returning when a cleaning instruction for the nozzle surface 112 is received from the operation button 46 (S5: YES). When the CPU 11 determines as returning (S5: YES), the CPU 11 performs purge as return processing A, as follows (S6). As shown in FIG. 11, the CPU 11 opens the electromagnetic valves 781, 782 and 783 in a state where the cap 91 is in contact with the nozzle surface 112 of the head part 110. Next, the CPU 11 drives the suction pump 190 for a certain time to discharge the cleaning liquid 76A of the cap 91 to the drainage tank 77. Next, as shown in FIG. 7, the CPU 11 closes the electromagnetic valve 781, opens the electromagnetic valve 783, and drives the suction pump 190 for a certain time to perform the above-described purge processing. Next, the CPU 11 controls the cap drive unit 18 (refer to FIG. 8) to separate the cap 91 from the nozzle surface 112. Next, the CPU performs a nozzle surface wiping operation of wiping off extra ink and the like remaining on the surface of the nozzle surface 112 of the head part 110 by the wiper 36 (refer to FIG. 2). Next, the CPU 11 executes printing processing (S1). Thereafter, the CPU performs the processing of S2 to S5, as described above.

When the CPU 11 does not determine as returning (S5: NO), the CPU determines whether it is a circulation time of the ink 68 (S7). For example, the CPU 11 determines that it is the circulation time, when 6 hours has elapsed from the end time of the last circulation operation A stored in the EEPROM 17 (S7: YES). When it is not determined that it is the circulation time (S7: NO), the CPU 11 advances the processing to S5 and performs the processing of S5 to S7. In addition, when YES is determined in the determination of S7, the CPU 11 determines whether an elapsed time from the end of the last end-job maintenance stored in the EEPROM 17 is within a predetermined time (S8). An example of the predetermined time is 3 days. When it is determined that the elapsed time is within the predetermined time from the end-job maintenance (S8: YES), the CPU 11 advances the processing to S4 and performs the circulation operation A in a similar manner to described above. Then, the CPU performs the processing of S5 to S8.

<Circulation Operation B>

Figure 12:
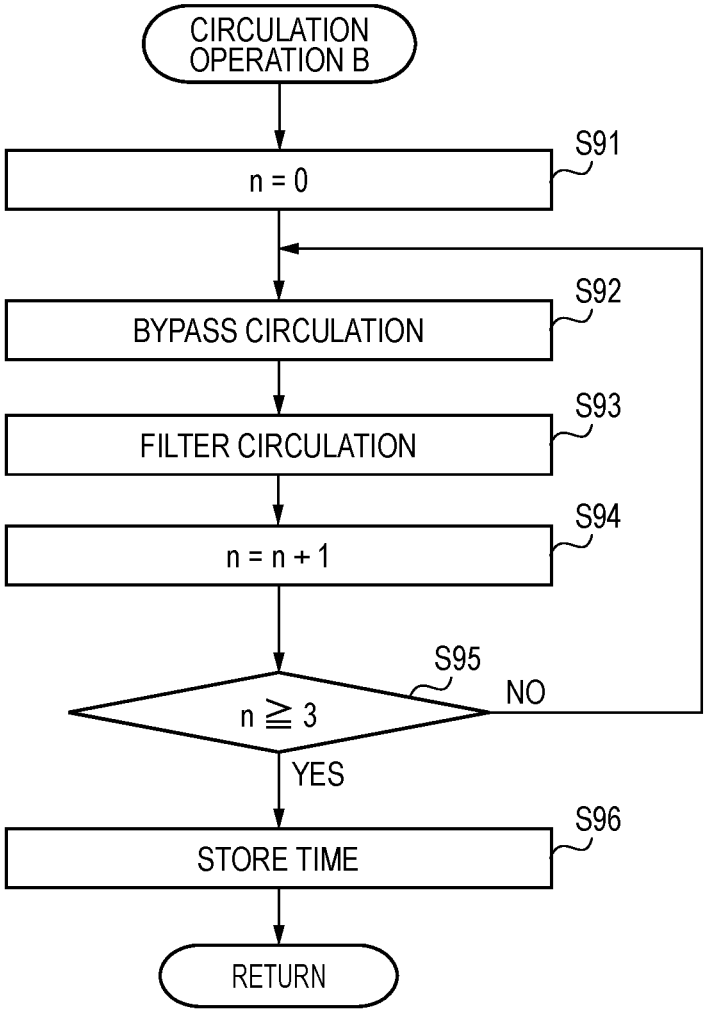
FIG. 12 is a sub-routine of a circulation operation B.

When it is not determined that the elapsed time is within the predetermined time from the end-job maintenance (S8: NO), i.e., when the elapsed time passes over a first elapsed time longer than the predetermined time, the CPU 11 executes a circulation operation B (S9). The CPU 11 executes the circulation operation B according to a sub-routine shown in FIG. 12. First, the CPU 11 resets the counter n as 'n=0' (S91). As shown in FIG. 12, the CPU 11 performs, as the circulation operation B, bypass circulation in the ink supply unit 700A and bypass circulation in the ink supply unit 700B (S92). That is, the head circulation is performed neither in the ink supply unit 700A nor in the ink supply unit 700B.

Then, as shown in FIG. 12, the CPU 11 performs filter circulation for the first nozzle row W1 and the second nozzle row W2, and performs filter circulation for the third nozzle row W3 and the fourth nozzle row W4 (S93).

Next, the CPU sets the counter n=n+1 (S94). Therefore, n=1. The CPU 11 determines whether n≥3 (S95), and when the CPU 11 does not determine n≥3 (S95: NO), the CPU advances the processing to S92, and repeats the processing of S92 to S95 in a similar manner to described above. When three sets of the bypass circulation and the filter circulation are executed, n=3, and therefore, the CPU 11 determines n≥3 (S95: YES). Next, the CPU 11 stores the end time of the circulation operation B in the EEPROM 17 (S96). Next, as shown in S11 of the flowchart of the liquid-contact circulation processing shown in FIGS. 9A and 9B, the CPU 11 determines whether the processing is returned from the liquid-contact state (S11). Since the determination processing of S11 is similar to the determination processing of S5, the description thereof is omitted.

<Return Processing B>

When the CPU 11 determines as returning (S11: YES), the CPU 11 executes return processing B (S10). The CPU 11 executes the return operation B according to a sub-routine shown in FIG. 14. First, the CPU 11 resets the counter n as 'n=0' (S101). Next, the CPU 11 executes the first circulation processing (S102). Next, the CPU 11 executes the second circulation processing (S103). Next, the CPU sets the counter n=n+1 (S104). Therefore, n=1.

Next, the CPU 11 determines whether n≥X (105), where X may be a predetermined value based on a test or the like, and is, for example, '1'. Next, when it is not determined as being n≥X (S105: NO), the CPU 11 advances the processing to S102 and repeats the processing of S102 to S105 in a similar manner to described above. When X sets of the first circulation processing (S102) and the second circulation processing (S103) are executed, the CPU 11 determines n≥X (S105: YES). Next, the CPU 11 executes the above-described purge (S106). After the execution of purge, the above-described nozzle surface wiping operation may be performed. Next, the CPU 11 advances the processing to S1 in the flowchart of the liquid-contact circulation processing shown in FIGS. 9A and 9B, and executes the processing of S1 to S11 in a similar manner to described above.

When the CPU 11 does not determine as returning (S11: NO), the CPU determines whether it is a circulation time of the ink 68 (S12). For example, the CPU 11 determines that it is the circulation time, when 6 hours has elapsed from the end time of the last circulation operation B stored in the EEPROM 17 (S12: YES). When it is not determined that it is the circulation time (S12: NO), the CPU 11 advances the processing to S11 and performs the processing of S11 to S12. In addition, when YES is determined in the determination of S12, the CPU 11 determines whether an elapsed time from the end of the last end-job maintenance stored in the EEPROM 17 passes over a second elapsed time (S13). An example of the second elapsed time is 14 days. When it is not determined that the elapsed time from the last end-job maintenance passes over the second elapsed time (S13: NO), the CPU 11 advances the processing to S9 and performs the circulation operation B in a similar manner to described above. Then, the CPU performs processing of S11 to S13.

<Circulation Operation C>

Figure 13:
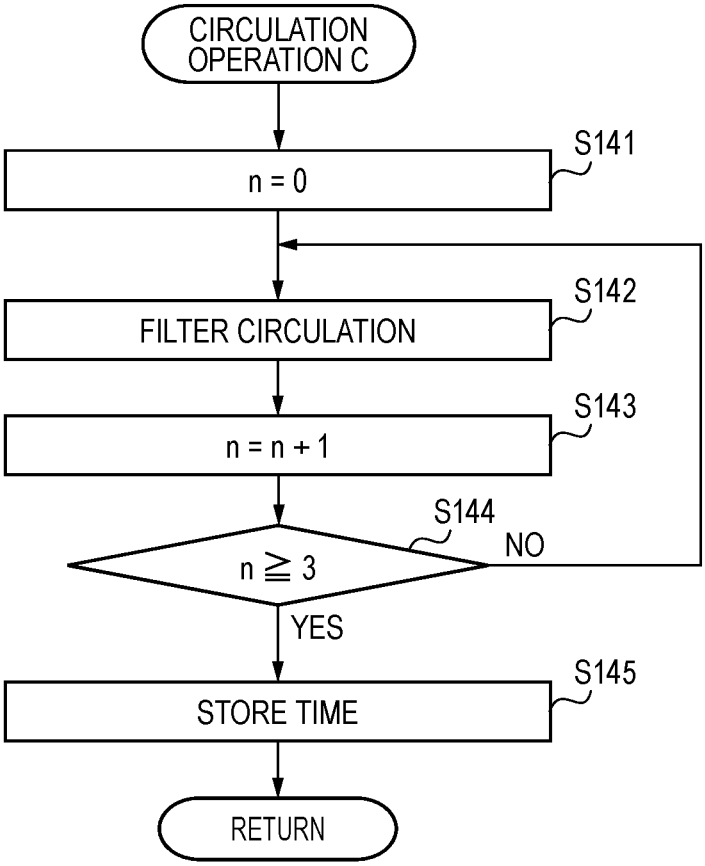
FIG. 13 is a sub-routine of a circulation operation C.

When it is determined that the elapsed time from the end-job maintenance passes over the second elapsed time (S13: YES), the CPU 11 executes a circulation operation C (S14). The CPU 11 executes the circulation operation C according to a sub-routine shown in FIG. 13. First, the CPU 11 resets the counter n as 'n=0' (S141). As shown in FIG. 13, the CPU 11 performs, as the circulation operation C, filter circulation for the first nozzle row W1 and the second nozzle row W2, and also performs filter circulation for the third nozzle row W3 and the fourth nozzle row W4 (S142).

Next, the CPU sets the counter n=n+1 (S143). Therefore, n=1. The CPU 11 determines whether n≥3 (S144), and when the CPU 11 does not determine n≥3 (S144: NO), the CPU advances the processing to S142, and repeats the processing of S142 to S144 in a similar manner to described above. When three sets of the filter circulation are executed, n=3, and therefore, the CPU 11 determines n≥3 (S144: YES). Next, the CPU 11 stores an end time of the circulation operation C in the EEPROM 17 (S145).

Next, the CPU 11 determines whether the processing is returned from the liquid-contact state by processing of S15 in the flowchart of the liquid-contact circulation processing shown in FIGS. 9A and 9B (S15). Since the determination processing of S15 is similar to the determination processing of S5 and S11, the description thereof is omitted.

<Return Processing C>

When the CPU 11 determines as returning (S15: YES), the CPU 11 executes return processing C (S16). The CPU 11 executes the return operation C according to a sub-routine shown in FIG. 15. First, the CPU 11 resets the counter n as 'n=0' (S161). Next, the CPU 11 executes the first circulation processing (S162). Next, the CPU 11 executes the second circulation processing (S163). Next, the CPU sets the counter n=n+1 (S164). Therefore, n=1.

Next, the CPU 11 determines whether n≥Y (165). Y is a value that satisfies a relationship of 'X<Y' with respect to the value 'X' of the return processing B. The value 'Y' may be a predetermined value based on a test or the like, and is, for example, '2'. Next, when it is not determined as being n≥Y (S165: NO), the CPU 11 advances the processing to S162 and repeats the processing of S162 to S165 in a similar manner to described above. When Y sets of the first circulation processing (S162) and the second circulation processing (S163) are executed, the CPU 11 determines n≥Y (S165: YES). Next, the CPU 11 executes the purge (S166). Next, the CPU 11 advances the processing to S1 in the flowchart of the liquid-contact circulation processing shown in FIGS. 9A and 9B, and executes the processing of S1 to S15 in a similar manner to described above.

When the CPU 11 does not determine as returning (S15: NO), the CPU determines whether it is a circulation time of the ink 68 (S17). For example, the CPU 11 determines that it is the circulation time, when 6 hours has elapsed from the end time of the last circulation operation C stored in the EEPROM 17 (S17: YES). When it is not determined that it is the circulation time (S17: NO), the CPU 11 advances the processing to S15 and performs the processing of S15 to S17. In addition, when YES is determined in the determination of S17, the CPU 11 advances the processing to S14 and performs the circulation operation C (S14). Thereafter, the CPU repeats processing of S14 to S17.

<Operational Effects of Disclosure>

As described above, when the elapsed time from the end-job maintenance (S3), which is the last cleaning in the cap 91, is within the predetermined time (S8: YES), the CPU 11 of the printer 1 executes the circulation operation A (S4) in the state where the cleaning liquid 76A supplied in the cap 91 is in contact with the nozzle surface 112. In the circulation operation A, the CPU 11 executes the head-inside circulation of circulating the ink 68 through the fourth flow path 714C, the head part 110 (the first nozzle row W1 and second nozzle row W2-side) and the fifth flow path 715C, and the head-inside circulation of circulating the ink 68 through the fourth flow path 714D, the head part 110 (the third nozzle row W3 and fourth nozzle row W4-side) and the fifth flow path 715D. When the elapsed time is longer than the predetermined time (S8: NO), the CPU 11 executes the circulation operation B (S9), and executes the head-outside circulation of circulating the ink 68 through the fourth flow path 714C, the second bypass flow path 802, the fifth flow path 715C, the fourth flow path 714D, the second bypass flow path 902, and the fifth flow path 715D without passing through the head part 110 (the first nozzle row W1, second nozzle row W2, third nozzle row W3 and fourth nozzle row W4-side). Therefore, when the elapsed time from the last cleaning in the cap 91 is longer than the predetermined time (S8: NO), the CPU 11 does not execute the head-inside circulation and executes the head-outside circulation. Therefore, it is possible to reduce a possibility that the ink in the cap 91 will flow out, thereby reducing the ink remaining in the cap 91. Therefore, it is possible to reduce a concern that the agglomerates (resin component) of the ink 68 will block the exhaust hole 662 (refer to FIG. 7) and the drainage flow path 122 (refer to FIG. 7), which are the flow paths of the ink 68 during the purge. Further, it is possible to reduce a possibility that the moisturizing effect of the foam (not shown) in the cap 91 will be weakened can be reduced, and further, to reduce a possibility that the liquid-contact effect will be weakened.

The printer 1 includes the first nozzle row W1, the second nozzle row W2, the third nozzle row W3 and the fourth nozzle row W4, which are a plurality of nozzle rows provided on the nozzle surface 112, the plurality of manifolds 170A, 170B, 180A and 180B configured to supply the ink 68 to the nozzles 111 provided in the first nozzle row W1, the second nozzle row W2, the third nozzle row W3 and the fourth nozzle row W4, respectively, the fourth flow paths 714C and 714D connected to at least any one of the manifolds 170A, 170B, 180A and 180B and configured to supply the ink 68, and the fifth flow paths 715C and 715D connected to at least any one of the manifolds 170A, 170B, 180A and 180B and configured to circulate the ink 68 from the manifolds 170A, 170B, 180A and 180B to which the ink 68 has been supplied by the fourth flow paths 714C and 714D. In addition, the cap 91 is configured to be in contact with the nozzle surface 112 on the outside of the nozzles 111 provided in at least two nozzle rows, respectively. Further, when the CPU 11 executes the head-inside circulation, the CPU 11 executes the first circulation processing where the circulation of the ink 68 through the fourth flow path 714C, the manifolds 170A and 180A and the fifth flow path 715C is performed and the circulation of the ink 68 through the fourth flow path 714D, the manifolds 170B and 180B and the fifth flow path 715C is not performed, in the liquid-contact state. Therefore, during the head-inside circulation, the CPU 11 can reduce a positive pressure, which is applied to the nozzles 111, by executing the first circulation processing, as compared to a case where the ink 68 is circulated at the same time through all the manifolds 170A, 170B, 180A and 180B, thereby reducing the ink 68 that will flow into the cap 91.

In the printer 1, at least one of the fourth flow paths 714A and 714B and the fifth flow paths 715A and 715B is provided with the filters 75A to 75D configured to filter the ink 68. After the head-inside circulation (S42, S43) of the circulation operation A (S4), the CPU 11 also performs the filter circulation (S46) of performing the circulation of the ink 68 through the fourth flow paths 714A and 714B, the filters 75A to 75D and the fifth flow paths 715A and 715B. Therefore, it is possible to remove deposits of the filters 75A to 75D by performing the filter circulation.

As the head-outside circulation, when the elapsed time from the end-job maintenance (S3), which is the last cleaning in the cap 91, passes over the first elapsed time longer than the predetermined time (S8: NO), the CPU 11 executes, as the circulation operation B, the bypass circulation (S92) of performing the circulation of the ink 68 through the fourth flow path 714C, the second bypass flow path 802, the fifth flow path 715C, the fourth flow path 714D, the second bypass flow path 902, and the fifth flow path 715D, respectively, and the filter circulation (S93) of performing the circulation of the ink 68 through the fourth flow paths 714A and 714B, the filters 75A to 75D, and the fifth flow paths 715A and 715B, respectively. When the elapsed time passes over the second elapsed time longer than the first elapsed time (S13: YES), the CPU 11 does not execute the bypass circulation, and executes the filter circulation (S142), as the circulation operation C. Therefore, when the elapsed time from the last cleaning in the cap 91 becomes long, the bypass circulation is not performed and only the filter circulation is performed. In the filter circulation, the ink 68 passes through the filters 75A and 75B or the filters 75C and 75D, so that a flow rate of the ink 68 becomes slow. Therefore, the load that is applied to the pumps 752A and 752B is reduced, and therefore, the suction capability is not reduced, and the possibility that the positive pressure will be generated in the nozzles 111 can be reduced. Therefore, the ink that will flow into the cap 81 can be reduced.

When the elapsed time from the last cleaning (S3) in the cap 91 is longer than the predetermined time (S8: NO), the CPU 11 executes the head-outside circulation in the liquid-contact state. In the head-outside circulation, the ink 68 circulates at a position farther from the nozzles 111 than in the head-inside circulation. Therefore, the positive pressure that is applied to the nozzles 111 is reduced. Therefore, when the elapsed time is longer than the predetermined time, the head-outside circulation is executed in the liquid-contact state. Accordingly, a possibility that air bubbles will be introduced from the nozzles 111 into the head part 110 is reduced.

After executing the head-inside circulation (S4) in the circulation operation A, when the CPU 11 receives a printing instruction or a cleaning instruction for the nozzle surface 112 and determines as returning from the liquid contact state (S5: YES), the CPU discharges the cleaning liquid 76A in the cap 91 and executes the purge in the return processing A (S6). Therefore, the cleaning liquid 76A in the nozzles 111, which may have been introduced during the liquid-contact, can be discharged to develop menisci of the nozzles 111 and to prepare printing. The cleaning instruction for the nozzle surface 112 is, for example, an instruction to execute the cleaning processing such as the wiping on the nozzle surface 112 by the wiper 36 and the purge.

The printer 1 includes the first nozzle row W1, the second nozzle row W2, the third nozzle row W3 and the fourth nozzle row W4, which are a plurality of nozzle rows provided on the nozzle surface 112, the plurality of manifolds 170A, 170B, 180A and 180B configured to supply the ink 68 to the nozzles 111 provided in the first nozzle row W1, the second nozzle row W2, the third nozzle row W3 and the fourth nozzle row W4, respectively, the fourth flow paths 714C and 714D connected to at least any one of the manifolds 170A, 170B, 180A and 180B and configured to supply the ink 68, and the fifth flow paths 715C and 715D connected to at least any one of the manifolds 170A, 170B, 180A and 180B and configured to circulate the ink 68 from the manifolds 170A, 170B, 180A and 180B to which the ink 68 has been supplied by the fourth flow paths 714C and 714D. In addition, the cap 91 is configured to be in contact with the nozzle surface 112 on the outside of the nozzles 111 provided in at least two nozzle rows, respectively. After executing the head-outside circulation (S92, S93) in the circulation operation B (S10), when the CPU 11 receives a printing instruction or a cleaning instruction for the nozzle surface 112 and determines as returning from the liquid contact state (S11: YES), the CPU executes the first circulation processing (S102) where the circulation of the ink 69 through the fourth flow path 714C, the manifolds 170A and 180A and the fifth flow path 715C is performed and the circulation of the ink 69 through the fourth flow path 714D, the manifolds 170B and 180B and the fifth flow path 715D is not performed, in the liquid-contact state. Thereafter, the CPU discharges the cleaning liquid 76A in the cap 91 and executes the purge (S106). Therefore, when a printing instruction or a cleaning instruction for the nozzle surface is received after executing the head-outside circulation, the first circulation processing is executed, so that it is possible to eliminate precipitation of the ink 68 and to reduce the outflow of the ink 68 into the cap 91. Thereafter, by executing the purge, the cleaning liquid 76A in the nozzles 111 can be discharged to develop menisci of the nozzles 111 and to prepare printing.

In a case where the CPU 11 receives a printing instruction or a cleaning instruction for the nozzle surface 112 and determines as returning (S11: YES), when the elapsed time from the last cleaning in the cap 91 passes over the first elapsed time longer than the predetermined time (S8: NO), the CPU executes the first circulation processing (S102) and the second circulation processing (S103), as the return processing B (S10), and when the elapsed time passes over the second elapsed time longer than the first elapsed time (S13: YES), the CPU executes the first circulation processing (S162) and the second circulation processing (S163), which are the head-inside processing where the circulating force is increased, as compare to the first circulation processing (S102) and the second circulation processing (S103). Therefore, the first circulation processing (S162) or the second circulation processing (S163) can be executed according to the length of the elapsed time. Therefore, in the case of the second elapsed time in which the elapsed time is longer than the first elapsed time, the positive pressure that is applied to the nozzles 111 is reduced by the first circulation processing (S162) or the second circulation processing (S163), so that the ink 68, which will flow into the cap 91, can be reduced and the precipitation of the ink can be eliminated.

The present invention is not limited to the above disclosure, and may be variously changed without departing from the gist of the present disclosure. For example, in the first circulation processing (S42) and the second circulation processing (S43), on the first nozzle row W1 and second nozzle row W2-side, and on the third nozzle row W3 and fourth nozzle row W4-side, the circulation is not limited to the combination of the head-inside combination and the head-outside circulation, and only the head-inside circulation may be performed. In addition, the CPU 11 determines the elapsed time from the end-job maintenance (S3) in the determination processing of S8 and S13, but may also determine an elapsed time from the end of the printing processing (S1). Note that, as for the last cleaning in the cap, the cleaning liquid may flow into the cap 91, regardless of the liquid-contact state. Further, in the circulation operation A, the CPU 11 performs the filter circulation processing (S46) after the first circulation processing (S42) and the second circulation processing (S43) where the head-inside circulation is performed, but may perform the filter circulation processing (S46) before the head-inside circulation. That is, the filter circulation processing (S46) is preferably executed at least at any one timing before and after the first circulation processing (S42) and the second circulation processing (S43), but the filter circulation processing (S46) is not necessarily required to be executed. The number of times of the first circulation processing (S42) and the second circulation processing (S43) in the circulation operation A is not limited to three times. In addition, the number of times of the filter circulation processing is not limited to three sets. Further, the number of times of the bypass circulation (S92) and the filter circulation (S93) in the circulation operation B is not limited to three times. Further, the number of times of the filter circulation (S142) in the circulation operation B is not limited to three times. These number of times may be determined as appropriate by a test or the like.

Further, in the determination of S7, S12 and S17, the elapsed time is not limited to 6 hours, the circulation time may be determined when a time appropriately determined based on a test or the like elapses from the end time of the last circulation operation. In addition, the predetermined time in S8 is not limited to 3 days. Further, the second elapsed time in S13 is not limited to 14 days, and may be determined as appropriate by a test or the like. Further, the value of X in the determination of S105 in the return processing B is not limited to 1, and the value of Y in the determination of S165 in the return processing C is not limited to 2. That is, values that satisfy the relationship of $X<Y$ may be determined as appropriate by a test or the like. Further, in the return processing C (S16), the circulating force of the ink 68 may be increased by increasing a number of rotations, lengthening a rotation time or increasing a number of revolutions per minute (rpm) of the pumps 752A and 752B in the first circulation processing (S162) and the second circulation processing (S163), as compared to the return processing B (S10).

Figure 10:
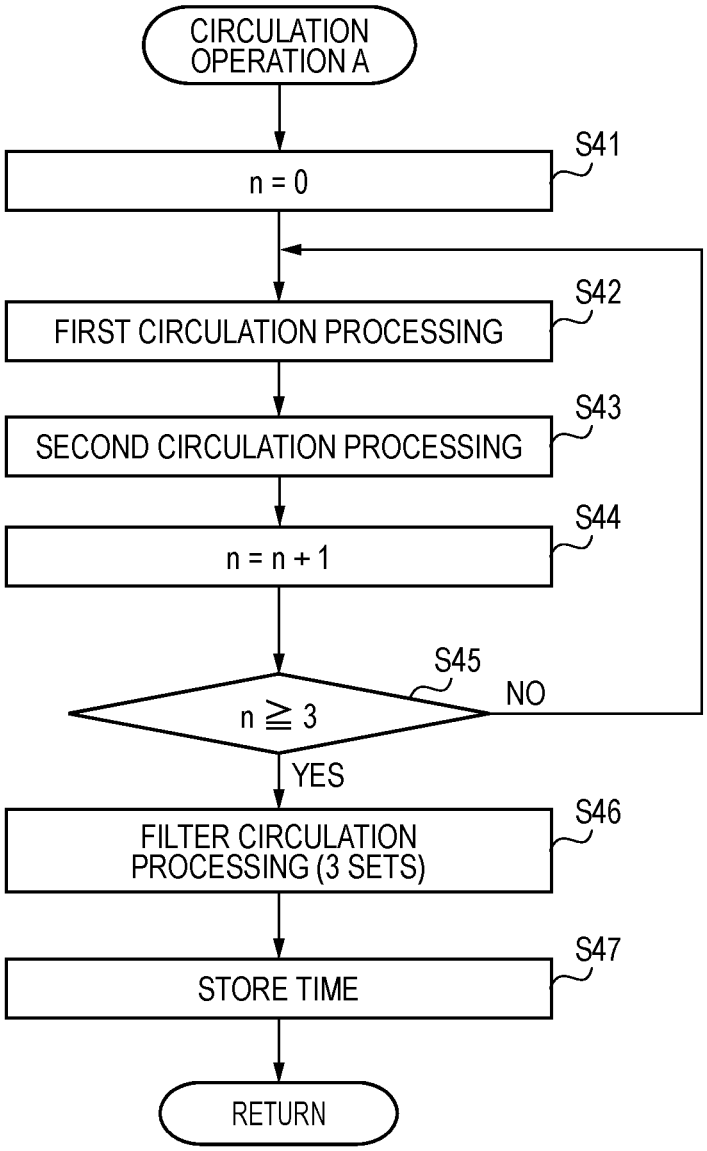
FIG. 10 is a sub-routine of a circulation operation A.
Figure 14:
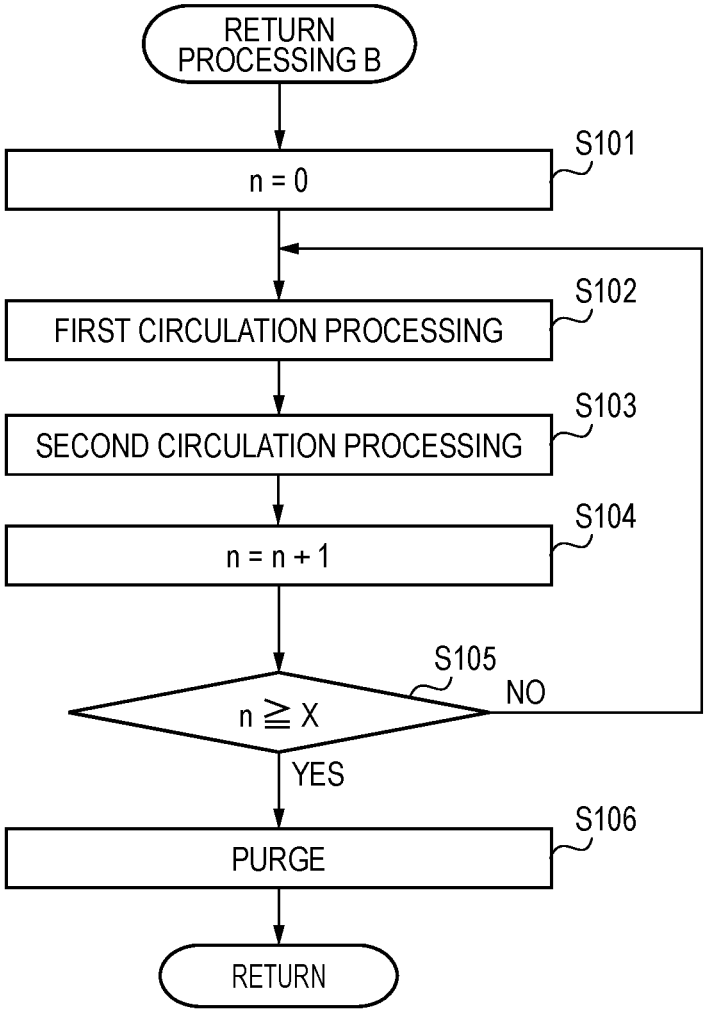
FIG. 14 is a sub-routine of return processing B.
Figure 15:
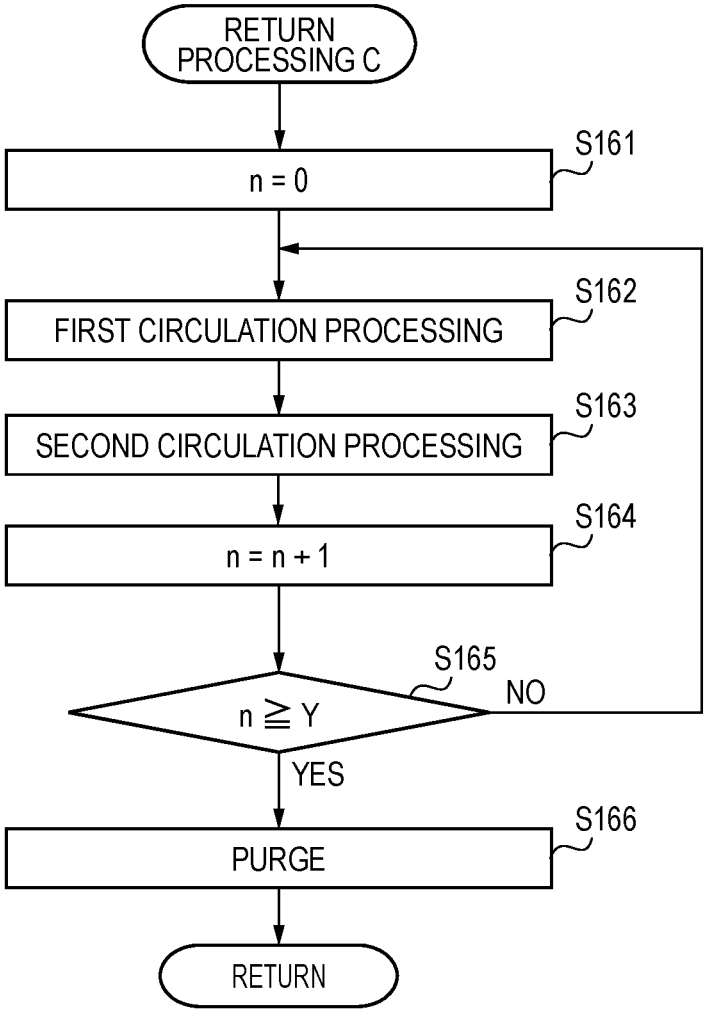
FIG. 15 is a sub-routine of return processing C.

The filter circulation may be performed instead of the bypass circulation in the first circulation processing (S42)

and the second circulation processing (S43) of the circulation operation A shown in FIG. 10, the first circulation processing (S102) and the second circulation processing (S103) of the return processing B shown in FIG. 14, and the first circulation processing (S162) and the second circulation processing (S163) of the return processing C shown in FIG. 15. In the filter circulation, since the ink 68 passes through the filters 75A and 75B or the filters 75C and 75D, a flow rate of the ink 68 becomes slow, the load that is applied to the pumps 752A and 752B is reduced, and the suction capability is not reduced. Therefore, a possibility that a positive pressure will be generated in the nozzles 111 can be reduced. Further, when the filters 75A to 75D are located on the nozzles 111-side with respect to the first bypass flow paths 801A and 801B, the resistance of the filter and the load of the flow path in the head part 110 are applied during the head-inside circulation, so that loads of the pumps 752A and 752B increase. Therefore, in the present disclosure, the filters 75A to 75D are provided upstream of the first bypass flow paths 801A and 801B. Further, since the bypass circulation is closer to the nozzles 111 of the head part 110 than the filter circulation, the negative pressure that is applied to the nozzles 111 is greater, as compared to the filter circulation. Therefore, in the first circulation processing and the second circulation processing, the positive pressure that is generated in the cap 91 can be reduced by setting the bypass circulation as the circulation that is executed at the same time as the head circulation. Further, it is not necessary to circulate the ink 68, instead of the bypass circulation of the first circulation processing and the second circulation processing. In this case, since the circulation of the ink 68 is not performed, the positive pressure associated with the circulation of the ink 68 is not generated. Therefore, the positive pressure that is generated in the cap 91 can be reduced. Further, in the liquid-contact circulation, the liquid that is filled in the cap 91 is not limited to the cleaning liquid 76A, and may also be the ink 68 ejected from the nozzles 111 of the head part 110.

The head-inside circulation is not limited to the circulation of the ink 68 between the manifold 170A of the first nozzle row W1 and the manifold 180A of the second nozzle row W2 and between the manifold 170B of the third nozzle row W3 and the manifold 180B of the fourth nozzle row W4. For example, although the plurality of manifolds 171 to 174 is provided to the flow path 62A, one manifold may also be provided. The supply ports may be provided at the front and rear ends of one or more manifolds. For example, the flow path 62A shown in FIG. 4 may be connected to the supply port at the front end of the manifold, and the flow path 62B shown in FIG. 4 may be connected to the supply port at the rear end of the manifold. Similarly, the flow path 62C shown in FIG. 4 may be connected to the supply port at the front end of the separate manifold, and the flow path 62D shown in FIG. 4 may be connected to the supply port at the rear end of the separate manifold. In this case, the cap may surround only the nozzles corresponding to the two manifolds. Therefore, in one of the first circulation processing and the second circulation processing shown in S42 and S43, the CPU 11 may execute the circulation processing in the manifold connected to the flow paths 62A and 62B, and in the other of the first circulation processing and the second circulation processing, the CPU 11 may execute the circulation processing in the manifold connected to the flow paths 62C and 62D. Therefore, in the above disclosure, there are four nozzle rows, but in this modified example, it is sufficient to provide at least two nozzle rows. In the present disclosure, the head-inside circulation may be executed when the elapsed time is within the predetermined time, and the head-outside circulation may be executed when the elapsed time is longer than the predetermined time. That is, the head-inside circulation and the head-outside circulation may be performed in at least one manifold including at least one nozzle row. In this case, the cap 91 may surround the nozzles 111 corresponding to at least one nozzle row.

In addition, the head-outside circulation is not necessarily required to be performed in the liquid-contact state. Further, in the ink supply unit 700A, the bypass flow path may be provided other than the first bypass flow path 801A and the second bypass flow path 802. For example, a third bypass flow path configured to connect the fourth flow path 714C and the fifth bypass flow path 715C may be provided between the first bypass flow path 801A and the second bypass flow path 802. The bypass circulation may be performed via the first bypass flow path 801A, the fourth flow path 714C, the fifth flow path 715C and the third bypass flow path. The same applies to the ink supply unit 700B. Further, in the circulation operation A, the number of times that the first circulation processing (S42) and the second circulation processing (S43) are performed is not limited to three times. In addition, the number of times of the filter circulation processing is not limited to three sets. An appropriate number of times may be set by a test. Further, in the return processing A to C, the flushing of ejecting the ink 68 from the nozzles 111 to the flushing receiving part 145 may be performed.

What is claimed is:

1. An inkjet printer comprising:

a nozzle surface provided on a head and having a nozzle configured to eject ink;

a first flow path connected to the head;

a second flow path connected to the head;

a bypass flow path configured to connect the first flow path and the second flow path outside the head;

a cap provided to be in contact with the nozzle surface; and a controller configured to execute:

head-inside circulation of circulating the ink through the first flow path, the head and the second flow path, in a liquid-contact state where a cleaning liquid supplied in the cap is contacted with the nozzle surface, at an end of last printing or in a case where an elapsed time from last cleaning in the cap is within a predetermined time; and head-outside circulation of circulating the ink through the first flow path, the bypass flow path and the second flow path without passing through the head, in a case where the elapsed time is longer than the predetermined time.

2. The inkjet printer according to claim 1, comprising:

a plurality of nozzle rows provided on the nozzle surface;

a plurality of manifolds configured to supply the ink to the nozzles provided in each nozzle row;

a plurality of the first flow paths connected to at least one of the manifolds and configured to supply the ink to the manifold connected to the first flow paths; and a plurality of the second flow paths connected to at least one of the manifolds and configured to circulate the ink from the manifold to which the ink is supplied through the first flow path, wherein the cap is configured to be in contact with the nozzle surface on an outside of the nozzles provided in at least two of the nozzle rows, and the controller is configured to execute circulation processing where circulation of the ink through one of the first flow paths, one of the manifolds and one of the second flow paths is performed, and circulation of the ink through another of the first flow paths, another of the manifolds and another of the second flow paths is not performed, in the liquid-contact state, during the head-inside circulation.

3. The inkjet printer according to claim 1, wherein at least one of the first flow path or the second flow path is provided with a filter configured to filter the ink, and the controller is configured to execute filter circulation of circulating the ink through the first flow path, the filter and the second flow path, before or after the head-inside circulation or before and after the head-inside circulation.

4. The inkjet printer according to claim 1, wherein at least one of the first flow path or the second flow path is provided with a filter configured to filter the ink, and the controller is configured to execute, as the head-outside circulation, bypass circulation of circulating the ink through the first flow path, the bypass flow path and the second flow path, and filter circulation of circulating the ink through the first flow path, the filter and the second flow path, in a case where the elapsed time passes over a first elapsed time longer than the predetermined time, and the filter circulation without executing the bypass circulation, in a case where the elapsed time passes over a second elapsed time longer than the first elapsed time.

5. The inkjet printer according to claim 1, wherein the controller is configured to execute the head-outside circulation, in the liquid-contact state, in the case where the elapsed time is longer than the predetermined time.

6. The inkjet printer according to claim 5, wherein the controller is configured to execute purge to discharge a cleaning liquid in the cap, in a case where a printing instruction or a cleaning instruction for the nozzle surface is received after executing the head-inside circulation.

7. The inkjet printer according to claim 1, comprising:

a plurality of nozzle rows provided on the nozzle surface;

a plurality of manifolds configured to supply the ink to the nozzles provided in each nozzle row;

a plurality of the first flow paths connected to at least one of the manifolds and configured to supply the ink to the manifoldconnected to the first flow paths; and a plurality of the second flow paths connected to at least one of the manifolds and configured to circulate the ink from the manifold to which the ink is supplied through the first flow path, wherein the cap is configured to be in contact with the nozzle surface on an outside of the nozzles provided in at least two of the nozzle rows, and wherein in a case where a printing instruction or a cleaning instruction for the nozzle surface is received after executing the head-outside circulation, the controller is configured to execute:

circulation processing where circulation of the ink through one of the first flow paths, one of the manifolds and one of the second flow paths is performed, and circulation of the ink through another of the first flow paths, another of the manifolds and another of the second flow paths is not performed; and purge to discharge a cleaning liquid in the cap, after executing the circulation processing.

8. The inkjet printer according to claim 1, wherein in a case where a printing instruction or a cleaning instruction for the nozzle surface is received, the controller is configured to execute:

first return processing in a case where the elapsed time passes over a first elapsed time longer than the predetermined time; and second return processing that is the head-inside processing in which a circulating force is increased as compared to the first return processing, in a case where the elapsed time passes over a second elapsed time longer than the first elapsed time.

9. A non-transitory computer-readable medium storing computer-readable instructions, when executed by a computer of an inkjet printer comprising:

a nozzle surface provided on a head and having a nozzle configured to eject ink;

a first flow path connected to the head;

a second flow path connected to the head;

a bypass flow path configured to connect the first flow path and the second flow path outside the head;

a cap provided to be in contact with the nozzle surface; and the computer, wherein the computer-readable instructions cause the computer to execute:

head-inside circulation of circulating the ink through the first flow path, the head and the second flow path, in a liquid-contact state where a cleaning liquid supplied in the cap is contacted with the nozzle surface, at an end of last printing or in a case where an elapsed time from last cleaning in the cap is within a predetermined time; and head-outside circulation of circulating the ink through the first flow path, the bypass flow path and the second flow path without passing through the head, in a case where the elapsed time is longer than the predetermined time.

* * * * *